US008070272B2

(12) United States Patent
Toba

(10) Patent No.: US 8,070,272 B2
(45) Date of Patent: Dec. 6, 2011

(54) LIQUID CONTAINER ADAPTED TO BE MOUNTED ON A CARRIAGE TO RECIPROCATE TOGETHER WITH A LIQUID EJECTING HEAD

(75) Inventor: Koichi Toba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1061 days.

(21) Appl. No.: 11/578,769

(22) PCT Filed: Jun. 16, 2005

(86) PCT No.: PCT/JP2005/011046

§ 371 (c)(1),
(2), (4) Date: Oct. 17, 2006

(87) PCT Pub. No.: WO2005/123397

PCT Pub. Date: Dec. 29, 2005

(65) Prior Publication Data

US 2007/0242114 A1 Oct. 18, 2007

(30) Foreign Application Priority Data

Jun. 16, 2004 (JP) ..... P2004-178385
Jun. 18, 2004 (JP) ..... P2004-181061
Jun. 18, 2004 (JP) ..... P2004-181062
Jun. 21, 2004 (JP) ..... P2004-182461

(51) Int. Cl.
*B41J 2/175* (2006.01)

(52) U.S. Cl. ..... 347/86; 347/85

(58) Field of Classification Search ..... 347/86, 347/6, 92; 436/172
See application file for complete search history.

(56) References Cited

U.S. PATENT DOCUMENTS 5,272,092 A * 12/1993 Hamasaki et al. ..... 436/172
6,419,349 B1 * 7/2002 Iwanaga et al. ..... 347/86
6,722,762 B2 4/2004 Miyazawa et al.

(Continued)

FOREIGN PATENT DOCUMENTS

CN 1390705 A 1/2003

(Continued)

OTHER PUBLICATIONS

European Search Report dated Jan. 19, 2010 issued in European Pat. Appln. No. 05751229.5.

(Continued)

*Primary Examiner* — Stephen Meier
*Assistant Examiner* — Carlos A Martinez
(74) *Attorney, Agent, or Firm* — Stroock & Stroock & Lavan LLP

(57) ABSTRACT

An ink cartridge 500 according to the invention is mounted on a carriage to reciprocate together with a coating head and serves to supply an ink in an air side containing portion 270 and a supply side containing portion 290 to the coating head. The air side containing portion 270 and first and second ink containing portions 292 and 294 are formed by a liquid containing concave portion 122 of a cartridge body 120 having one open surface opposed to a direction of a reciprocation of the coating head and a film 140 for sealing the open surface of the liquid containing concave portion 122. A stirring and moving member 711 is accommodated in the air side containing portion 270 and the second ink containing portion 294 in a movable state, respectively.

15 Claims, 16 Drawing Sheets

U.S. PATENT DOCUMENTS

| | | | | |
|---|---|---|---|---|
| 6,742,878 | B2 | 6/2004 | Hara et al. | |
| 6,863,376 | B2 | 3/2005 | Seino et al. | |
| 6,926,396 | B2 | 8/2005 | Ota et al. | |
| 6,945,641 | B2 | 9/2005 | Sakai et al. | |
| 6,955,422 | B2 | 10/2005 | Miyazawa et al. | |
| 6,966,638 | B2 | 11/2005 | Ota et al. | |
| 7,165,835 | B2 | 1/2007 | Ota et al. | |
| 2002/0109760 | A1 | 8/2002 | Miyazawa et al. | |
| 2002/0171722 | A1* | 11/2002 | Hara et al. | 347/86 |
| 2003/0067518 | A1 | 4/2003 | Ishinaga et al. | |
| 2003/0103119 | A1* | 6/2003 | Sakai et al. | 347/92 |
| 2004/0252146 | A1* | 12/2004 | Naka et al. | 347/6 |

FOREIGN PATENT DOCUMENTS

| | | | |
|---|---|---|---|
| JP | 04-169269 | | 6/1992 |
| JP | 04-169269 | A | 6/1992 |
| JP | 05-131645 | A | 5/1993 |
| JP | 09-309212 | A | 12/1997 |
| JP | 2001-232171 | A | 8/2001 |
| JP | 2003-080730 | A | 3/2003 |
| JP | 2003-266730 | A | 9/2003 |
| JP | 2003311993 | * | 11/2003 |
| WO | 2004/028817 | A1 | 4/2004 |

OTHER PUBLICATIONS

International Search Report for PCT/JP2005/011046 (Aug. 30, 2005), w/ Engl. transln.

* cited by examiner

LIQUID CONTAINER ADAPTED TO BE MOUNTED ON A CARRIAGE TO RECIPROCATE TOGETHER WITH A LIQUID EJECTING HEAD

TECHNICAL FIELD

The present invention relates to a liquid container for supplying a liquid accommodated in an inner part to an outside and, for example, to a liquid container suitable as an ink cartridge attached to a carriage of an ink jet type recording apparatus and serving to supply an ink accommodated in an inner part to a print head.

BACKGROUND ART

In an ink jet type recording apparatus according to an example of a liquid ejecting apparatus, an ink cartridge accommodating an ink therein is attached, thereby discharging the ink to an object to be recorded and carrying out recording upon receipt of the supply of the ink from the ink cartridge.

A type of the ink to be used in the ink jet type recording apparatus includes a dye type and a pigment type, and an ink of the pigment type is obtained by uniformly dispersing dispersion particles such as a pigment into a solvent and mixing them. Such an ink of the pigment type has a property that print is not carried out for a long period of time and the dispersion particle sinks in a difference in a specific gravity between the solvent and the dispersion particle when the ink is put in a non-circulation state in an ink container.

As the ink cartridge for supplying the ink to the ink jet type recording apparatus, there has been developed an ink cartridge in which a division into an upper ink containing portion and a lower ink containing portion is carried out and these communicate with each other through a connecting passage (a communicating portion).

In the ink cartridge of this type, a liquid supply port for communicating with the upper ink containing portion is provided with liquid supply means for supplying the ink in the upper ink containing portion to the ink jet type recording apparatus based on a difference in a pressure between the ink jet type recording apparatus side and the ink cartridge side in the case in which the ink is consumed in the ink jet type recording apparatus (for example, see Patent Document 1).

However, the ink cartridge has a problem in that a thick ink sinking in the lower ink containing portion is first supplied to the upper ink containing portion through the connecting passage, and the thick ink is used and a thin ink is then supplied so that the thickness of the ink to be supplied to the ink jet type recording apparatus has a variation.

Moreover, the Patent Document 1 has described the ink cartridge having a structure in which a passage is disposed in the perpendicular and horizontal portions of an L-shaped partition wall surrounding a connecting passage. In the structure, the connecting passage is provided just below the passage of the horizontal portion. Therefore, there is a problem in that the ink in the vicinity of the horizontal portion meets the connecting passage and a flow in a vertical direction in which the thick ink and the thin ink are stirred is not generated in the lower ink containing portion.

Therefore, there has been proposed an ink cartridge having a structure in which a stirring and moving member for moving in each ink containing portion to stir a liquid in the ink containing portion is put in the containing portion and a thick ink and a thin ink which are separated vertically in the ink containing portion are mixed again by a stirring force generated by the stirring and moving member, thereby causing the thickness of the ink to be supplied to be uniform (for example, see Patent Documents 2 and 3).

Patent Document 1: JP-A-2003-80730
Patent Document 2: JP-A-2003-266730
Patent Document 3: JP-A-9-309212

DISCLOSURE OF THE INVENTION

Problems to be Solved

In a conventional ink cartridge in which the stirring and moving member is put in the ink containing portion, however, a peripheral wall for dividing and forming the ink containing portion is provided by a partition wall or rib having a high rigidity which is formed integrally with a cartridge body and a lid member which are made of a synthetic resin. When the stirring and moving member moves in the ink containing portion with a reciprocating operation of a print head, for example, the stirring and moving member collides with the partition wall dividing and forming the ink containing portion so that an impulsive sound to be a noise might be generated or a vibration caused by the collision might influence precision in an ink supplying operation.

Accordingly, an object of the invention relates to a solution of the problems and is to provide a liquid container capable of supplying a liquid having a uniform concentration with high precision while suppressing a noise caused by the stirring and moving member in the liquid containing portion or a vibration caused by a collision.

In the conventional ink cartridge in which the stirring and moving member is put in the ink containing portion, moreover, there is a possibility that an opening of the connecting passage for an ink supply which is formed to penetrate through the partition wall of the ink containing portion might be blocked partially or wholly by the stirring and moving member to generate an ink supply failure depending on the shape of the opening of the connecting passage or the size of the stirring and moving member.

Therefore, another object of the invention relates to the solution of the problems and is to provide a liquid container capable of supplying a liquid having a uniform concentration with high precision by preventing a stirring and moving member accommodated in a liquid containing portion from blocking a connecting passage formed on a partition wall of the liquid containing portion to disturb a circulation of the liquid in the connecting passage.

Moreover, the shape of the moving member accommodated in the conventional ink cartridge generally takes a smooth and spherical shape. Although the moving member taking the spherical shape can easily roll and move in the cartridge and the ink can be stirred by a draining function fulfilled by the movement, a function for stirring the ink by its own rotation is poor.

Therefore, it is yet another object of the invention to provide a liquid container having a stirring and moving member for stirring an accommodated liquid in which a stirring property of the stirring and moving member is further enhanced.

By simply accommodating the stirring and moving member in the ink cartridge as in the conventional art, moreover, an excellent ink stirring function cannot always be obtained.

Therefore, it is a further object of the invention to provide a liquid container having a stirring and moving member for stirring an accommodated liquid in which a stirring function of the stirring and moving member is further enhanced.

Means for Solving the Problems

The objects of the invention can be achieved by a liquid container mounted on a carriage to reciprocate together with a liquid ejecting head and serving to supply a liquid in a liquid containing portion to the liquid ejecting head, wherein the liquid containing portion is formed by a liquid containing concave portion of a container body having at least one open surface opposed to a direction of a reciprocation of the liquid ejecting head and a film for sealing the open surface of the liquid containing concave portion, and a stirring and moving member is accommodated in the liquid containing portion in a movable state.

According to the structure, the stirring and moving member accommodated in the liquid containing portion moves in the liquid containing portion with the movement of the carriage to reciprocate together with the liquid ejecting head and thus collides with the film. However, the film is thinner than the wall of the container body and is easily deformed elastically. Therefore, the collision energy of the stirring and moving member is absorbed by the elastic deformation of the film.

As a result, a collision sound and a vibration which are generated in the collision of the stirring and moving member are reduced considerably. Consequently, it is possible to eliminate an influence on a noise and precision in an operation.

It is preferable that the film should be welded to a surface of the container body so that the open surface of the liquid containing concave portion is sealed.

According to the structure, the liquid containing concave portion of the container body is sealed by welding the film. Therefore, it is possible to easily carry out a manufacture.

Moreover, it is preferable that there should be provided a lid member fixed to the container body with an outside of the film covered therewith, and a buffer member disposed between the lid member and the film and serving to absorb a shock generated when the stirring and moving member in the liquid containing portion collides with the film.

According to the structure, the buffer member provided between the lid member and the film absorbs a collision sound and a shock in the collision of the stirring and moving member with the film. Therefore, a sound and a vibration which are generated by the collision of the stirring and moving member can be reduced more effectively. Thus, it is possible to provide a liquid container in which a silence and precision in an operation are further enhanced.

Because of the structure in which the outside of the film dividing and forming the liquid containing portion is covered with the lid member, moreover, it is possible to prevent the film from being broken due to an interference with an external apparatus in handling and to also have an excellent handling property.

In addition, it is preferable that the stirring and moving member should take a rollable shape.

In this case, the position of the stirring and moving member can be changed freely by the rolling operation. Therefore, the movement of the stirring and moving member in the liquid can be promoted so that an excellent stirring operation can be carried out.

The object of the invention can be achieved by a liquid container in which an inner part is divided into a plurality of liquid containing portions through a partition wall and a connecting passage for supplying an accommodated liquid to a downstream liquid containing portion is formed in a penetration in a close position to a bottom portion of the liquid containing portion in the partition wall extended in an almost vertical direction, wherein a stirring and moving member is accommodated in at least one of the liquid containing portions in a movable state and a minimum opening sectional area of a passage formed between a surrounding partition wall and the stirring and moving member when the stirring and moving member is caused to approach the connecting passage most greatly is set to be larger than a minimum opening sectional area of the connecting passage.

According to the structure, the stirring and moving member accommodated in the liquid containing portion moves. Also in the case in which the stirring and moving member approaches the connecting passage formed to penetrate through the partition wall most greatly, therefore, the minimum opening sectional area of the passage formed between the surrounding partition wall of the connecting passage and the stirring and moving member is set to be larger than that of the connecting passage. Consequently, it is possible to stably supply a liquid having a uniform concentration from the connecting passage while stirring the liquid in the liquid containing portion by the stirring and moving member without causing the stirring and moving member to block the connecting passage, thereby disturbing the circulation of the liquid.

It is preferable that the stirring and moving member should be set to have a predetermined size with respect to an opening of the connecting passage so that the minimum sectional area of the passage formed between the surrounding partition wall of the connecting passage and the stirring and moving member is set to be larger than the minimum opening sectional area of the connecting passage.

This case is effective for the case in which the stirring and moving member takes a spherical shape. By properly changing the size of the stirring and moving member, it is possible to easily set the minimum sectional area of the passage to be larger than the minimum opening sectional area of the connecting passage.

Moreover, it is preferable that a stopper for blocking a movement of the stirring and moving member to the connecting passage side should be provided in the liquid containing portion, and the closest distance of the stirring and moving member to the connecting passage should be regulated so that the minimum sectional area of the passage formed between the surrounding partition wall of the connecting passage and the stirring and moving member is set to be larger than the minimum opening sectional area of the connecting passage.

It is preferable that the stopper should be formed by a projection which is protruded from an internal wall of the liquid containing portion or a flexible member having a predetermined length which connects an internal wall of the liquid containing portion to the stirring and moving member.

This case is effective for the case in which the contour shape of the stirring and moving member is a shape other than the spherical shape or a stirring and moving member having a small outside diameter is used.

A liquid container according to the invention which can solve the problems comprises a liquid containing portion for accommodating a liquid therein and a liquid supply portion for causing the liquid containing portion to communicate with an outside, the liquid containing portion accommodating a stirring and moving member therein, wherein the stirring and moving member has such a structure as to roll irregularly.

According to the liquid container having such a structure, the stirring and moving member irregularly rolls and moves. Therefore, it is possible to cause an irregular force to act on a surrounding liquid in various directions. Consequently, it is possible to obtain a more excellent stirring function as compared with a stirring and moving member taking a simple spherical shape.

Furthermore, a liquid container according to the invention which can solve the problems comprises a liquid containing portion for accommodating a liquid and a liquid supply portion for causing the liquid containing portion to communicate with an outside, the liquid containing portion accommodating a stirring and moving member therein, wherein the stirring and moving member has at least one of a concave portion and a convex portion formed on a surface.

According to the liquid container having such a structure, also in the case in which the stirring and moving member rolls simply, the action for stirring the surrounding liquid is generated by the concave portion and the convex portion which are formed on the surface of the stirring and moving member. Therefore, it is possible to obtain a more excellent stirring function as compared with the stirring and moving member taking the simple spherical shape.

In the liquid container according to the invention, moreover, it is preferable that the stirring and moving member should have a position of a center of a shape with respect to its own external shape which is different from a position of a center of gravity. Even if the external shape is a spherical shape or another shape, consequently, it is possible to have a structure in which the stirring and moving member rolls irregularly.

In the liquid container according to the invention, furthermore, it is preferable that the stirring and moving member should take a shape of an elliptical sphere and a ratio of a minor axis to a major axis should be equal to or lower than 0.9. By using the stirring and moving member taking such a shape, it is possible to implement the irregular rolling operation for obtaining an excellent stirring function.

The inventor vigorously investigated the stirring and moving member for obtaining the excellent stirring function. Taking note of a relationship between the size of the liquid container for accommodating the stirring and moving member therein and the size of the stirring and moving member to be accommodated therein and the direction of the movement of the stirring and moving member which influence the stirring function of the liquid, it was found that the liquid can be stirred well by properly setting the size of the stirring and moving member.

A liquid container according to the invention which can solve the problems comprises a liquid containing portion for accommodating a liquid therein and a liquid supply portion for causing the liquid containing portion to communicate with an outside, the liquid containing portion accommodating a stirring and moving member therein, and mounted on a carriage mounting a liquid ejecting head to reciprocate to supply a liquid in the liquid containing portion to the liquid ejecting head through the liquid supply portion, wherein the stirring and moving member has a diameter which is 0.4 time as large as an internal width of the liquid containing portion in a direction of the reciprocation of the carriage or more and is 0.8 time as large as the internal width or less.

According to the liquid container having such a structure, the stirring and moving member accommodated in the liquid containing portion is apt to actively move in the direction of the reciprocation of the liquid ejecting head. Therefore, the size of the stirring and moving member is determined properly on the basis of the internal width of the liquid containing portion in the direction of the reciprocation of the liquid ejecting head which is such a length that the stirring and moving member can move in the direction of the movement. Accordingly, it is possible to greatly exhibit the stirring function of the stirring and moving member utilizing the reciprocation of the liquid ejecting head. Thus, it is possible to obtain an excellent stirring function for the liquid.

Also in the case in which the liquid in the liquid containing portion is a pigment ink in the liquid container according to the invention, furthermore, it is possible to suppress a variation in a thickness of the liquid to be supplied to the liquid ejecting head by stirring the pigment ink which easily sinks.

Advantage of the Invention

According to the liquid container in accordance with the invention, it is possible to supply a liquid having a uniform concentration with high precision by the stirring force of the stirring and moving member without the stirring and moving member in the liquid containing portion generating a great collision sound to be a noise and generating such a vibration as to influence precision in an operation by the collision of the stirring and moving member.

According to the liquid container in accordance with the invention, moreover, it is possible to supply a liquid having a uniform concentration with high precision without the stirring and moving member accommodated in the liquid containing portion blocking the connecting passage formed on the partition wall of the liquid containing portion to disturb the circulation of the liquid in the connecting passage.

According to the liquid container in accordance with the invention, furthermore, it is possible to further enhance the stirring property of the stirring and moving member in the liquid container having the stirring and moving member for stirring the accommodated liquid.

DESCRIPTION OF THE DESIGNATIONS

110: film, 111: ink containing portion (liquid containing portion), 120: cartridge body (container body), 120*a*: surface, 122: liquid containing concave portion, 130: film, 132: film, 140: lid member, 150: ink supply control means, 160: ink supply portion (liquid supply portion), 162: communicating portion, 163: communicating hole, 214: passage, 270: air side containing portion (liquid containing portion), 270*a*: liquid containing concave portion, 272: partition wall, 272*a*: supply side partition wall, 274: connecting passage, 290: supply side containing portion (liquid containing portion), 292: first ink containing portion (liquid containing portion), 292*a*: liquid containing concave portion, 294: second ink containing portion (liquid containing portion), 294*a*: liquid containing concave portion, 500: ink cartridge (liquid container), 510: first vertical partition wall portion (partition wall), 512: lower connecting passage (connecting passage), 513: lower wall portion, 514: upper connecting passage, 515: upper wall portion, 516: second upper connecting passage, 530: first vertical partition wall portion (partition wall), 530*a*: surface, 532: lower connecting passage (connecting passage), 533: lower wall portion, 534: upper connecting passage, 535: upper wall portion, 536: second upper connecting passage, 550: inclined wall portion, 624: air valve communicating portion, 650: air valve, 652: pressing member housing chamber, 654: air valve pressing member, 656: coil spring, 669: air valve chamber, 711: stirring and moving member, 715: stopper, 721: stopper, 750: cushion member (buffer member).

BEST MODE FOR CARRYING OUT THE INVENTION

A liquid container according to the invention is suitable for supplying a liquid to a liquid ejecting head of a liquid ejecting apparatus. For example, the liquid ejecting apparatus includes a liquid ejecting head (a print head) of an ink jet type recording apparatus, a coloring agent ejecting head of a color filter manufacturing apparatus for manufacturing a color filter of a liquid crystal display, an electrode material (conductive paste) ejecting head for forming an electrode of an organic EL display or an FED (a surface emitting display), and furthermore, a bioorganism ejecting head of a biochip manufacturing apparatus for manufacturing a biochip and a specimen ejecting head to be a precision pipette.

A preferred embodiment of the liquid container according to the invention will be described below in detail with reference to the drawings. In the embodiment, description will be given to an ink cartridge to be used with an attachment or removal to/from the ink jet type recording apparatus as an example of the liquid container.

Figure 1:
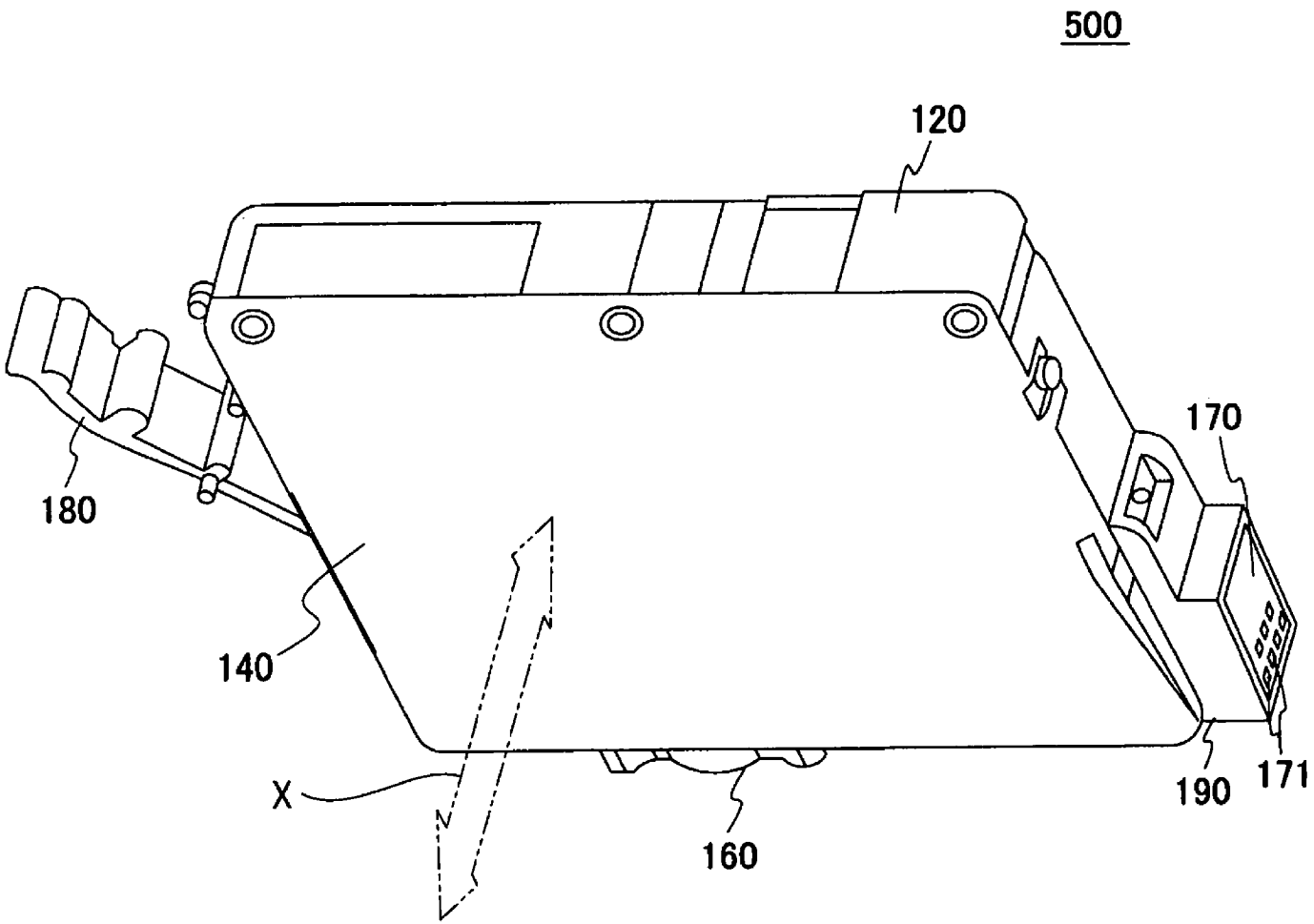
FIG. 1 is a front perspective view showing an ink cartridge according to an embodiment of a liquid container in accordance with the invention as seen obliquely and downward.

FIG. 1 is a front perspective view showing an ink cartridge 500 according to an embodiment of the liquid container in accordance with the invention as seen obliquely and downward. The ink cartridge 500 is a liquid container to be removably mounted on a carriage to reciprocate together with a print head (a liquid ejecting head) in the ink jet type recording apparatus.

Figure 2:
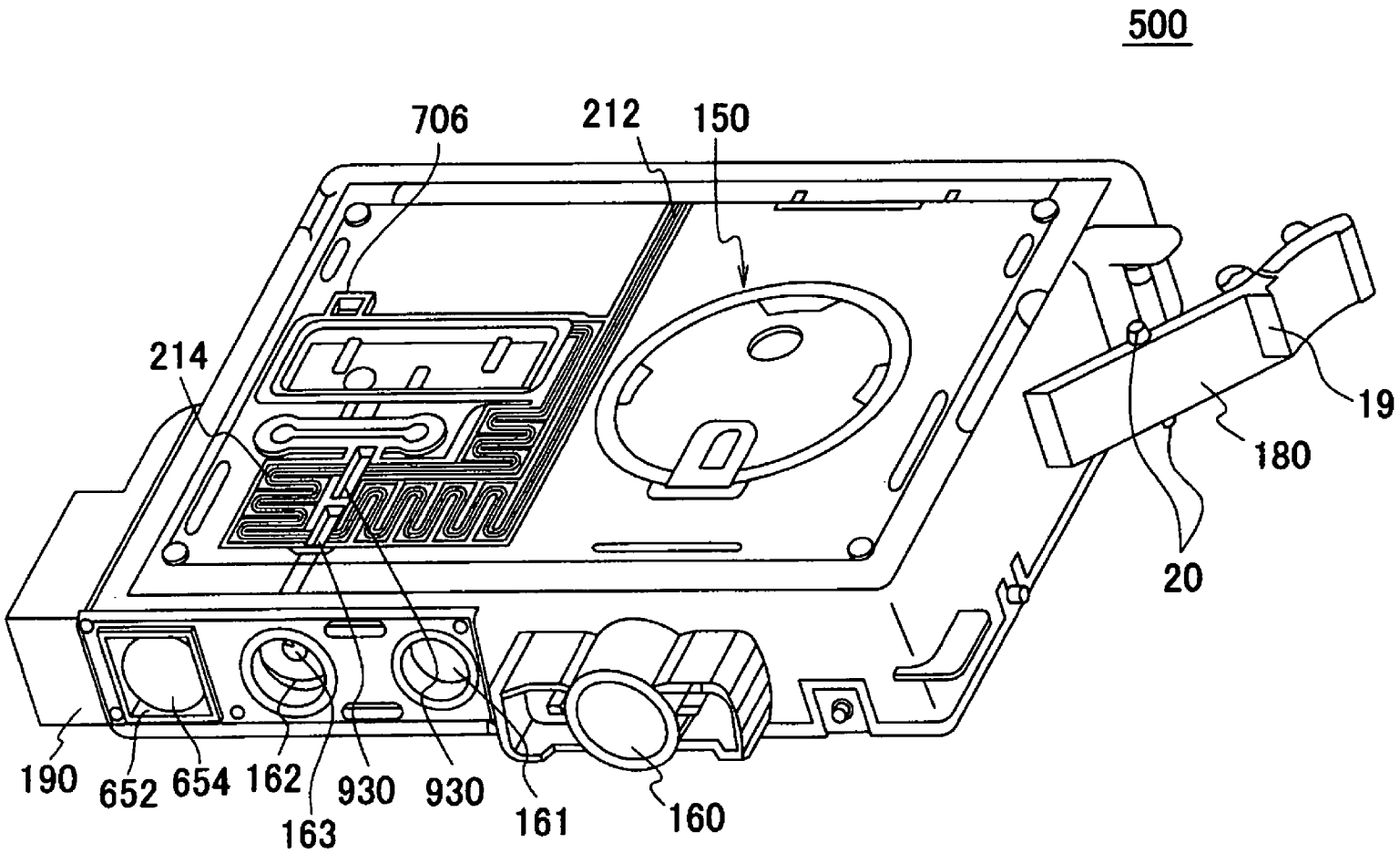
FIG. 2 is a rear perspective view showing a state brought before a film of the ink cartridge illustrated in FIG. 1 is stuck.
Figure 3:
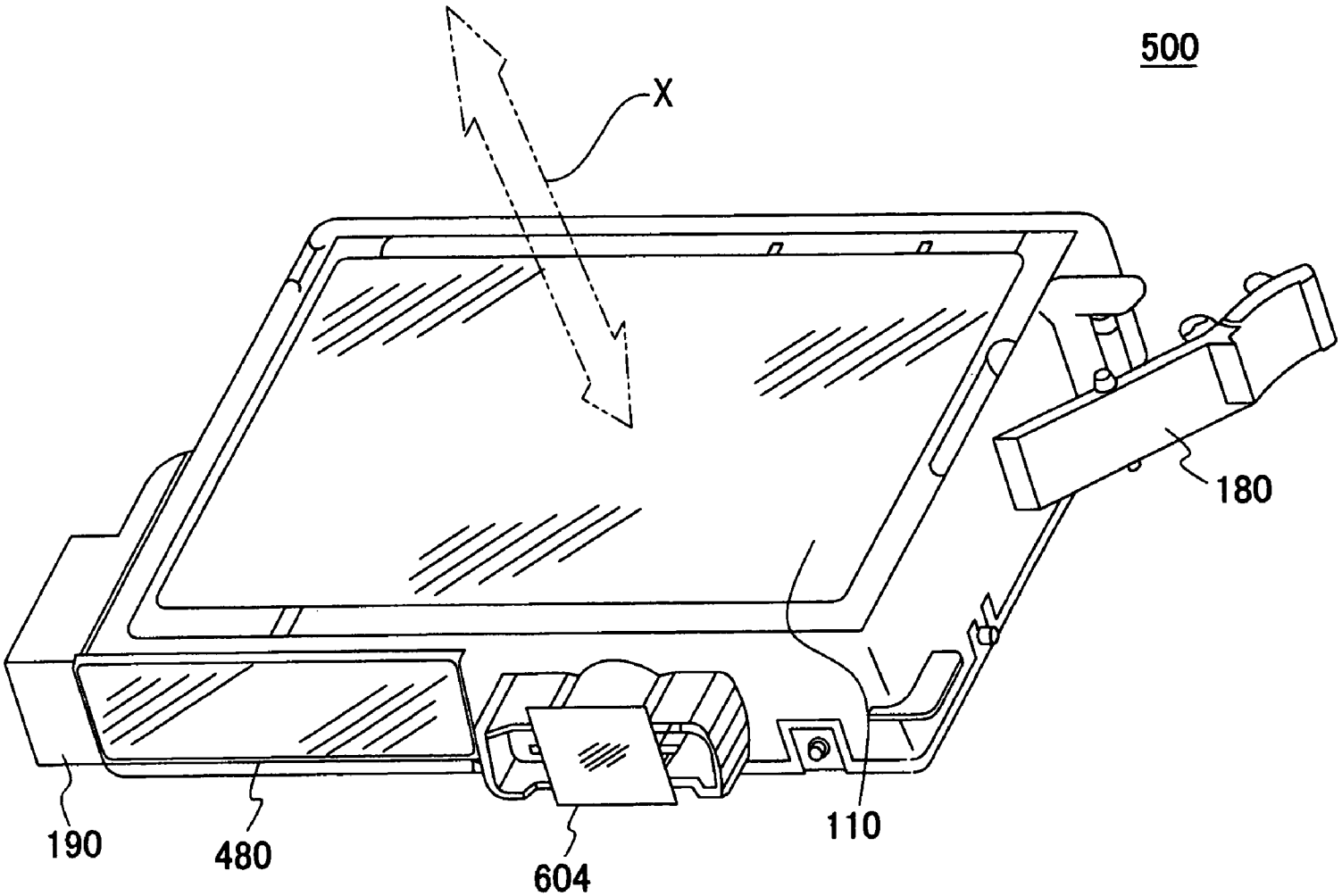
FIG. 3 is a rear perspective view showing a state brought after the film of the ink cartridge illustrated in FIG. 1 is stuck.

FIGS. 2 and 3 are rear perspective views showing the ink cartridge 500 illustrated in FIG. 1 as seen obliquely and upward, FIG. 2 shows a state brought before a film 110 is stuck to a surface of a cartridge body 120 of the ink cartridge 500 and FIG. 3 shows a state in which the film 110 is stuck to the cartridge body 120 of the ink cartridge 500. Furthermore, FIGS. 4 and 5 are exploded perspective views showing members constituting the ink cartridge 500 which are exploded.

An arrow X shown in FIGS. 1, 3, 11 and 18 indicates a direction of a reciprocation of the print head of the ink jet type recording apparatus.

Figure 6:
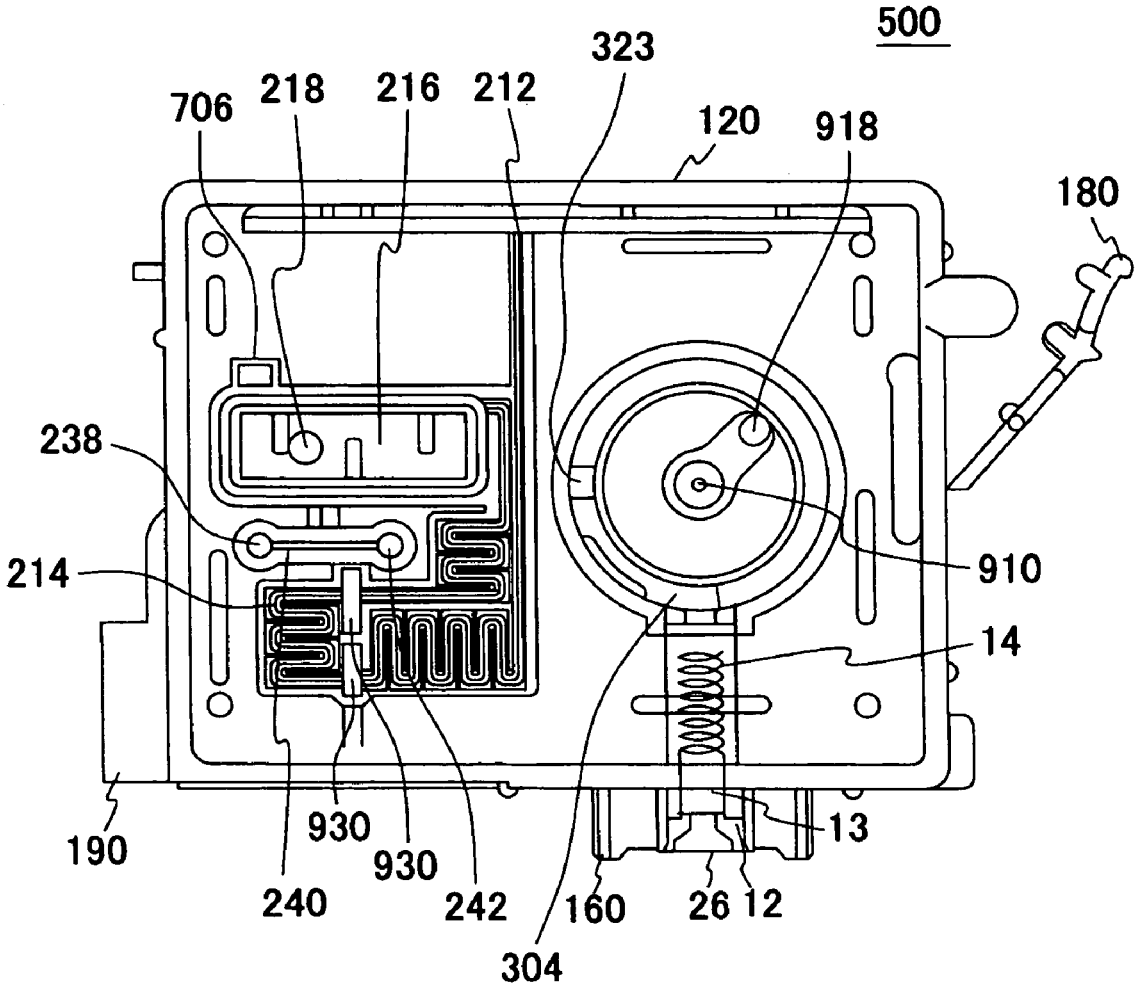
FIG. 6 is a rear view showing the state brought before the film of the ink cartridge illustrated in FIG. 1 is stuck.
Figure 7:
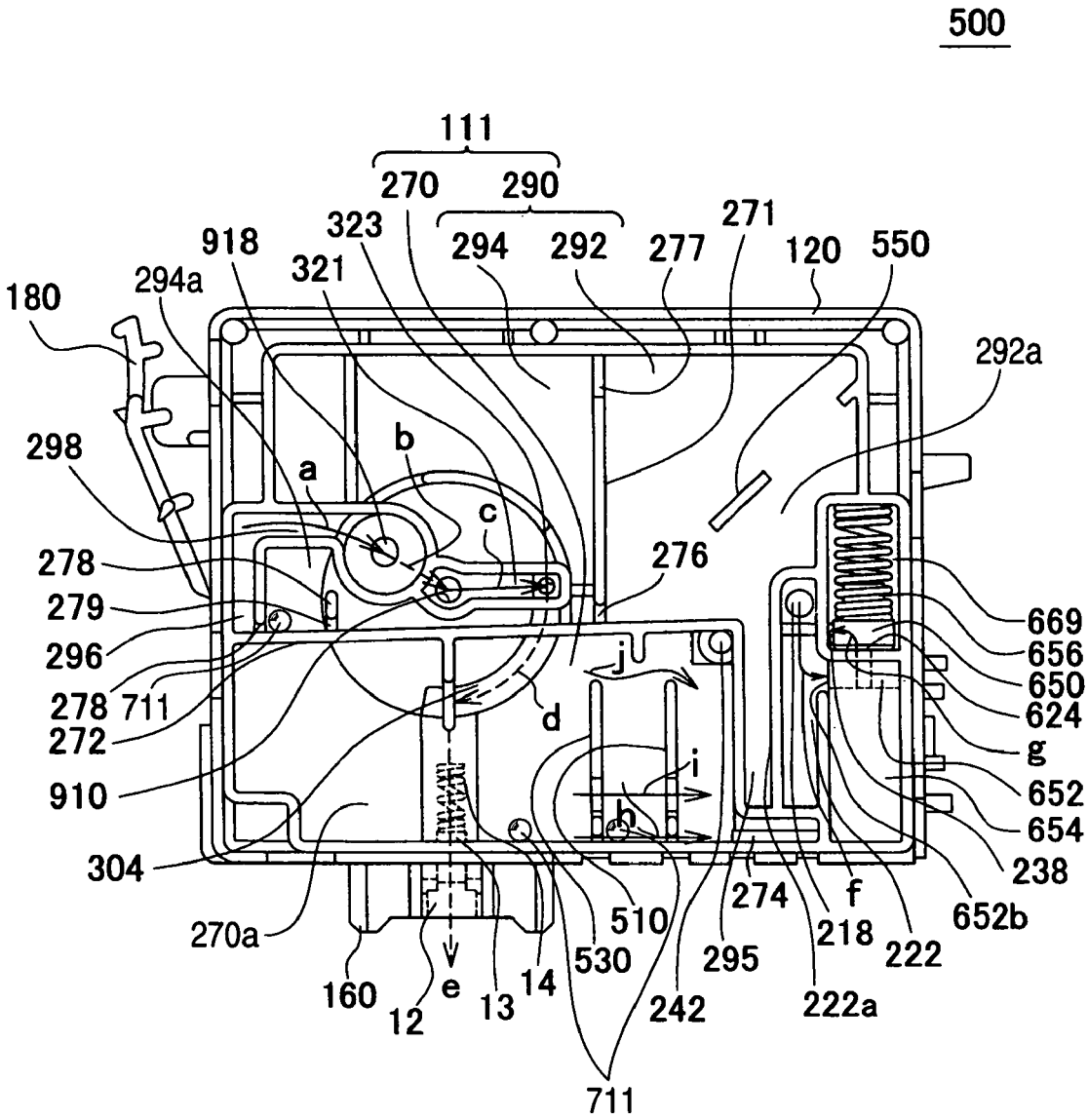
FIG. 7 is a front view showing the state brought before the film of the ink cartridge illustrated in FIG. 1 is stuck.
Figure 8:
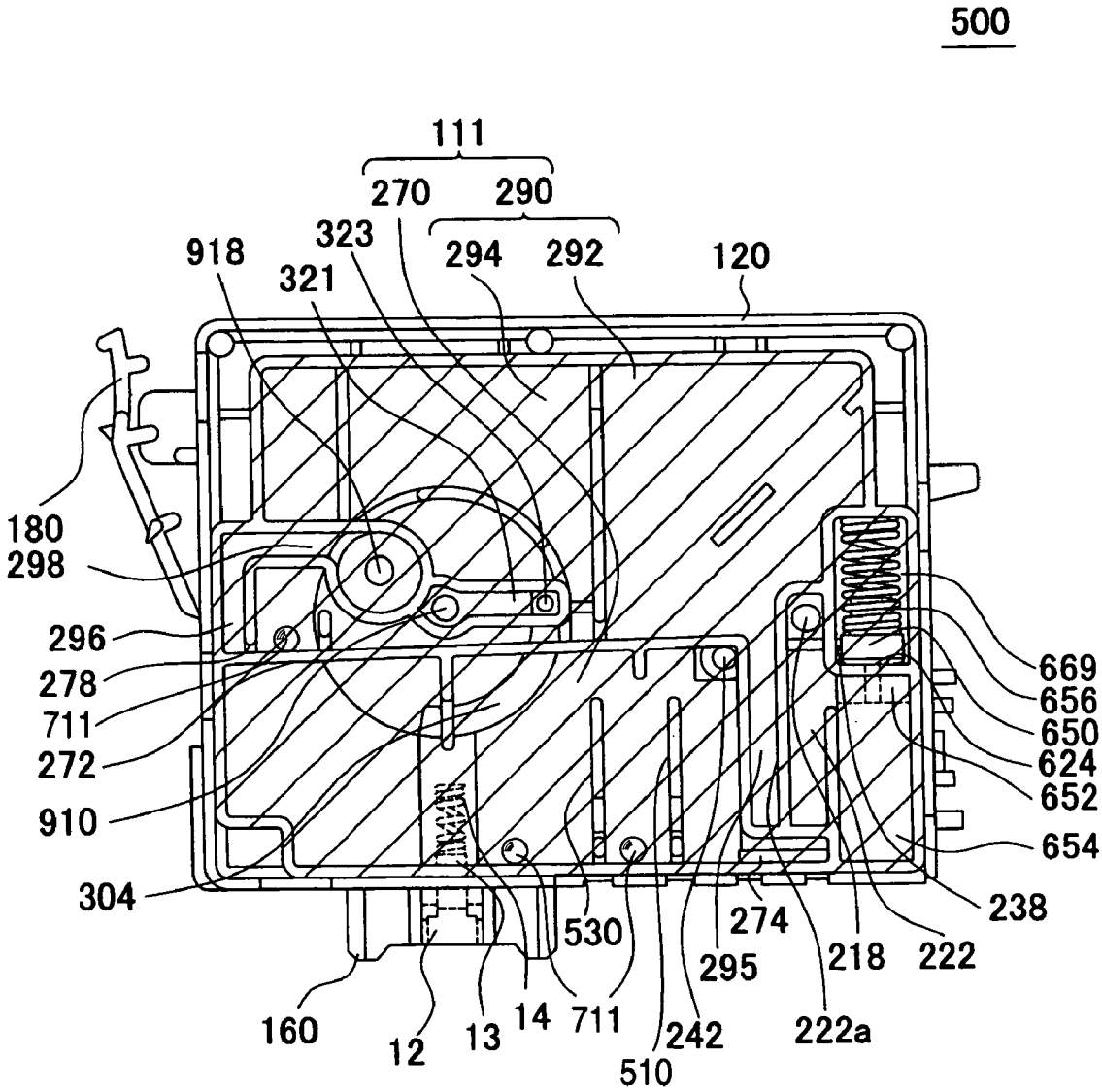
FIG. 8 is a front view showing the state brought after the film of the ink cartridge illustrated in FIG. 1 is stuck.

FIG. 6 is a rear view showing the ink cartridge 500 in FIG. 1, illustrating the state brought before the film 110 is stuck in the ink cartridge 500 of FIG. 1. FIG. 7 is a front view showing the ink cartridge 500 in FIG. 1, illustrating a state before a film 130 is stuck to a liquid containing concave portion 122 of the ink cartridge 500. FIG. 8 is a front view showing the ink cartridge 500 in FIG. 1, illustrating a state brought after the film 130 is stuck to the liquid containing concave portion 122 of the ink cartridge 500.

Figure 4:
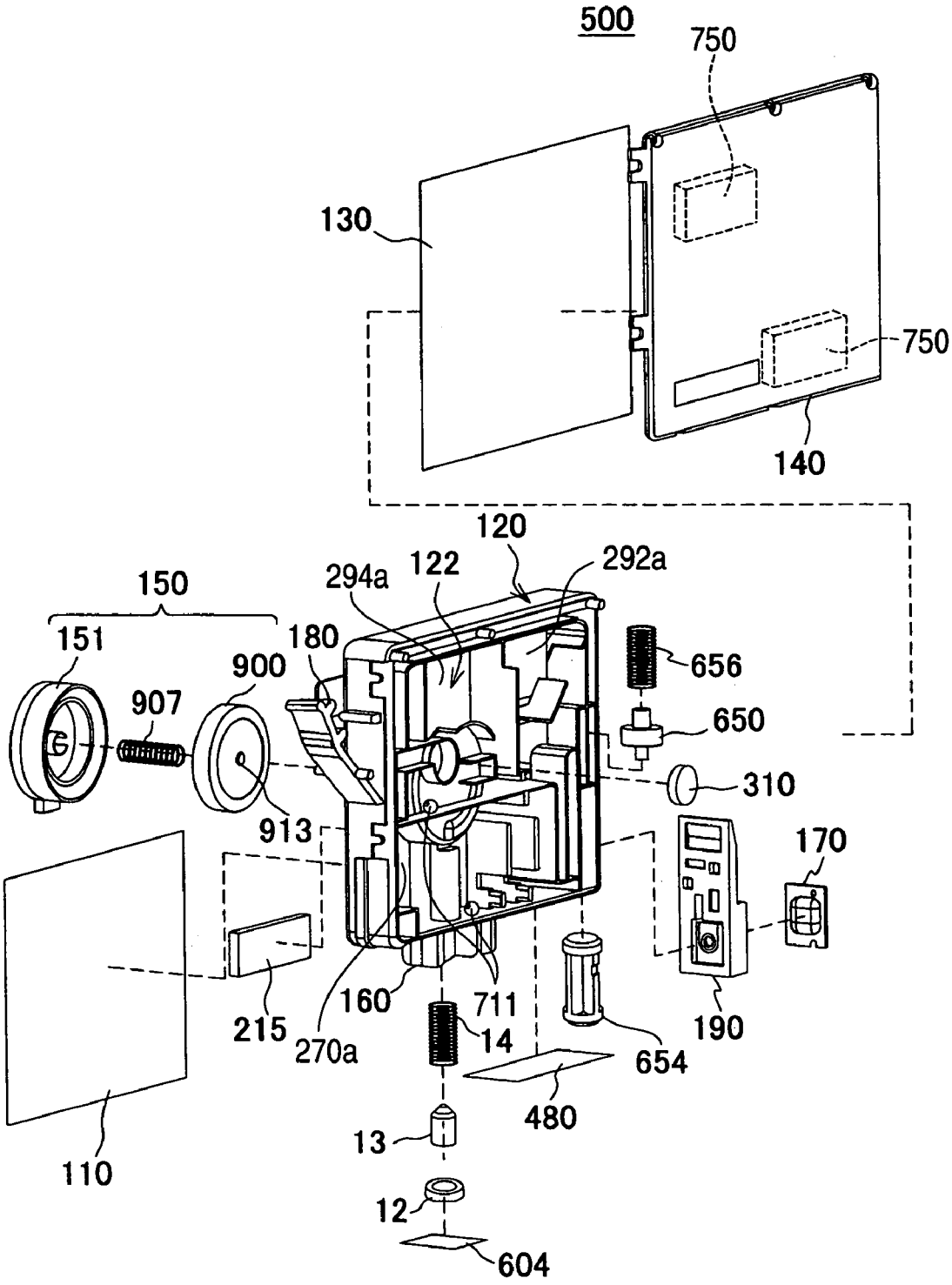
FIG. 4 is an exploded perspective view showing a front side of the ink cartridge illustrated in FIG. 1.
Figure 5:
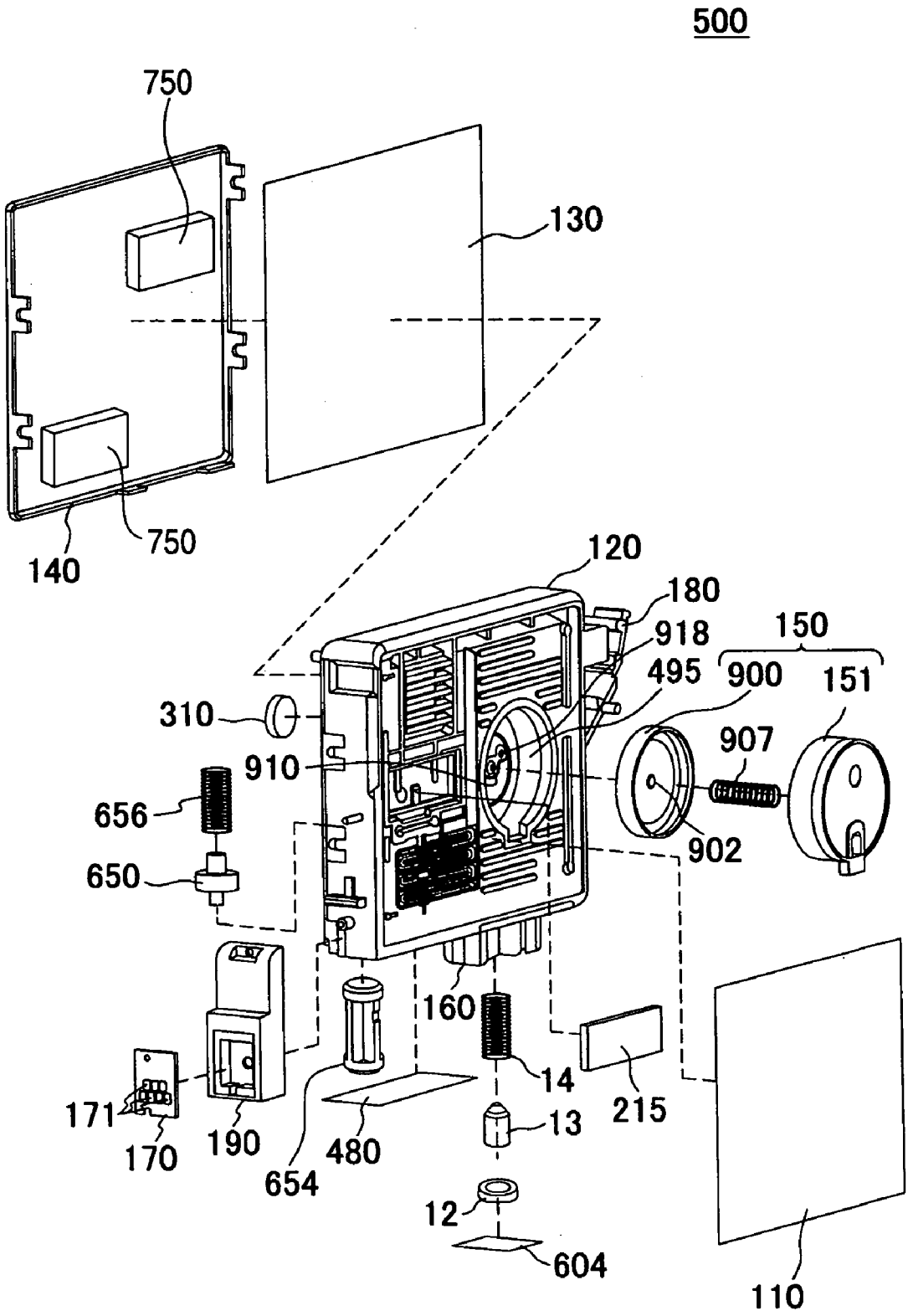
FIG. 5 is an exploded perspective view showing a rear side of the ink cartridge illustrated in FIG. 1.

As shown in FIG. 4, the ink cartridge 500 according to the embodiment comprises the bottomed cartridge body (container body) 120 taking an almost box shape which includes the liquid containing concave portion 122 having a front face to be one of surfaces opposed to the direction X of the reciprocation of the print head which is opened, the film 130 for covering almost the whole surface of the open surface in the liquid containing concave portion 122, and a lid member 140 for covering the outside of the film 130.

The cartridge body 120 is an integral molded product formed by a synthetic resin such as polypropylene (PP) and the liquid containing concave portion 122 of the cartridge body 120 is divided into a plurality of liquid containing concave portions 270*a*, 292*a* and 294*a* by means of a partition wall or a rib as will be described below.

Open surfaces of the liquid containing concave portions 270*a*, 292*a* and 294*a* are sealed in a liquid tightness with the film 130 and form a plurality of ink containing portions for accommodating an ink (liquid).

The film 130 is a transparent or translucent film formed by a resin which has a lower melting point than that of the cartridge body 120 and is welded to the partition wall or rib dividing the liquid containing concave portions 270*a*, 292*a* and 294*a*.

Before a processing of welding the film 130, a stirring and moving member 711 for stirring an accommodated ink is put in the liquid containing concave portions 270*a* and 294*a*.

The lid member 140 is fixed to the cartridge body 120 to cover the outside of the film 130.

Furthermore, the cartridge body 120 includes an ink containing portion 111 for accommodating the ink (see FIG. 7), an ink passage portion from the ink containing portion 111 to an ink supply portion 160, and an air communicating portion constituted by an ink side passage, an air valve housing portion and an air side passage which serve to cause the ink containing portion 111 to communicate with the air.

The ink cartridge 500 further comprises ink supply control means 150, the ink supply portion 160, storage means 170 and an engagement lever 180.

The ink supply portion 160 is provided on a lower surface of the cartridge body 120, and an ink supply needle formed on a carriage to which the ink cartridge 500 is to be attached is inserted to supply an ink accommodated in the ink containing portion 111 to the print head of the ink jet type recording apparatus.

The storage mans 170 is caulked by a fixing portion 190, and the fixing portion 190 is caulked in a lower part of a side surface of the cartridge body 120 and is thus attached.

Moreover, the storage means 170 stores information about a type of the ink cartridge 500, information about a color of an ink to be held in the ink cartridge 500 and information about the amount of the existing ink, and transfers these information together with the apparatus body by means of a plurality of terminals 171 which is exposed from a surface.

The engagement lever 180 is formed in an upper part of a side surface in the cartridge body 120 which is opposed to the fixing portion 190 and is engaged with the carriage of the ink jet type recording apparatus.

A side surface of the fixing portion 190 is constituted to be regulated by a rib (not shown) formed on the carriage in such a manner that the terminal 171 and an elastic contact on the carriage side reliably abut.

The ink supply control means 150 is constituted by a differential pressure valve for supplying the ink of the ink containing portion 111 to the ink supply portion 160 depending on a difference in a pressure between the ink containing portion 111 and the ink supply portion 160 which is generated together with a consumption of the ink. The ink supply control means 150 is elastically deformable and has a film valve 900 according to an example of a valve member to be inserted in a concave portion 495 of the cartridge body 120, a valve lid 151 for covering the concave portion 495, and a coil spring 907 according to an example of an energizing member disposed between the film valve 900 and the valve lid 151.

The ink containing portion 111 to be the liquid containing portion according to the embodiment is greatly divided into upper and lower parts through a partition wall 272 extended in a horizontal direction as shown in FIG. 7. The lower part of the partition wall 272 is provided with an air side containing portion 270 to be an ink containing portion which can communicate with the air by means of a communicating hole 242, and furthermore, the upper part is provided with a supply side containing portion 290 to be an ink containing portion constituted by a first ink containing portion 292 and a second ink containing portion 294 which are isolated from the air.

The supply side containing portion 290 is divided into the first and second ink containing portions 292 and 294 by means of a vertical partition wall 271 having a connecting passage (communicating portion) 276 in the vicinity of the partition wall 272 (a lower region), and furthermore, a passage portion 296 is disposed to be surrounded by the second ink containing portion 294.

The passage portion 296 is connected to the second ink containing portion 294 through a connecting passage 278 in the lower part, and furthermore, to the ink supply control means 150 through a passage 298 and a through hole 918.

The partition wall 271 has the lower connecting passage 276 together with the partition wall 272 and an upper connecting passage 277 together with an upper surface. A passage resistance of the upper connecting passage 277 is lower than that of the lower connecting passage 276.

Moreover, the second ink containing portion 294 is provided with a short and vertical partition wall 288, and a passage 279 is provided between the partition wall 288 and the partition wall 272.

Moreover, a downstream side of the ink supply control means 150 is constituted to communicate with the ink supply portion 160 through a through hole 910 communicating with the ink supply control means 150, a passage 321 communicating with the through hole 910, a through hole 323 formed on one of ends of the passage 321 and penetrating toward a surface side, and a communicating portion 304 having one end communicating with the through hole 323.

The air side containing portion 270 and the first ink containing portion 292 communicate with each other through a connecting passage 295 extended in a vertical direction and a communicating portion 162 (FIG. 2) penetrating through a bottom face of the air side containing portion 270. When the ink is consumed from the ink supply portion 160, accordingly, the ink in the air side containing portion 270 is correspondingly sucked up to the first ink containing portion 292 and flows therefrom into the ink supply control means 150 through the second ink containing portion 294 and the passage portion 296.

The ink flows from the air side containing portion 270 of the ink containing portion 111 into the ink supply control means 150 through a connecting passage 274, the communicating portion 162, a communicating hole 163, the air passage 295, the connecting passages 276 and 278, the passage portion 296, the passage 298 and the through hole 918 in this order.

The air side passage to be a side communicating with the air with an air valve communicating portion 624 set as a boundary is constituted by an opening 212, a meandering passage 214, a filter housing portion 216, a communicating hole 218 and a communicating portion 222, a through hole 652*b* formed on a side surface of the communicating portion 222, and a pressing member housing chamber 652 shown in FIG. 6.

In detail, as shown in FIG. 6, one passage 214 has one of ends which is formed on the surface side of the cartridge body 120 and meanders like a maze is opened as the opening 212 to the air and the other end connected to the filter housing portion 216 accommodating a filter 215 (FIGS. 4 and 5) having the functions of an ink-repellent property and a ventilating property.

The filter housing portion 216 communicates with the communicating hole 218 penetrating from the surface side of the cartridge body 120 to a back side thereof. The communicating hole 218 is connected to the pressing member housing chamber 652 through the communicating portion 222 and the through hole 652*b* formed on a side surface of the communicating portion 222. A chamber 930 formed by a concave portion is provided in the middle of the passage 214.

On the other hand, as shown in FIG. 7, the ink side passage setting the air valve communicating portion 624 to be the boundary is formed by an air valve chamber 669, a communicating hole 238, a communicating groove 240 and a communicating hole 242, thereby communicating with the air side containing portion 270 of the ink containing portion 111.

The communicating hole 238 penetrating from the back side of the cartridge body 120 to the surface side thereof communicates with the air side containing portion 270 through the communicating groove 240 communicating with the communicating hole 238 and the communicating hole 242 communicating with the communicating groove 240 and penetrating from the surface side of the cartridge body 120 to the back side thereof.

The air side containing portion 270, the supply side containing portion 290, the air valve chamber 669, the air side passage and the ink side passage are brought into regions isolated from the air by welding the films 130 and 110 to the partition wall for dividing them through a method such as thermal welding.

The ink supply portion 160 includes a seal member 12 formed by an elastomer and having an insertion port 26 in which the ink supply needle provided on the carriage is to be inserted, a supply valve 13 for blocking the insertion port 26 of the seal member 12, and an energizing member 14 constituted by a coil spring and serving to energize the supply valve 13 toward the seal member 12. A film 604 is stuck to the insertion port 26 of the seal member 12 in a shipment from a factory.

When the ink cartridge 500 is attached to the carriage of the ink jet type recording apparatus, a convex portion provided on the carriage pushes an air valve 650 upward through a film 480 and an air valve pressing member 654, and furthermore, the ink supply needle of the carriage pushes the supply valve 13 of the ink supply portion 160 upward.

As a result, the air valve communicating portion 624 causes the air passage from the air valve chamber 669 to the communicating hole 242 to communicate with the air. Moreover, an upstream from the supply valve 13 in the ink supply portion 160 communicates with the ink supply needle.

When the ink jet type recording apparatus starts recording in a state in which the communicating hole 242 communicates with the air, the ink is supplied from the ink supply portion 160 to the print head through the ink supply needle. When the ink is supplied from the ink supply portion 160, the ink flowing in order of an arrow a shown in FIG. 7 and the through hole 918 in the ink containing portion 111 flows into the ink supply portion 160 in order of arrows b, c, d and e shown in FIG. 7 via the ink supply control means 150 so that the ink is supplied to the ink supply needle inserted in the ink supply portion 160.

Corresponding to the flow of the ink, the ink in the air side containing portion 270 is supplied to the supply side containing portion 290 in the ink containing portion 111. With the consumption of the ink in the air side containing portion 270, the air flows from the communicating hole 242 into the air side containing portion 270 via a passage shown in arrows f and g in FIG. 7 in order. Although the ink is supplied from the ink supply portion 160 to the print head so that a liquid level of the air side containing portion 270 is lowered, the passage for connecting the air side containing portion 270 to the supply side containing portion 290 has a communicating port in the lowermost part of the air side containing portion 270. For this reason, the air does not flow into the supply side containing portion 290 until the whole ink in the air side containing portion 270 is moved to the supply side containing portion 290.

After the whole ink in the air side containing portion 270 is consumed, the inks in the first ink containing portion 292 and the second ink containing portion 294 in the supply side containing portion 290 are consumed in this order. In the meantime, the ink in the supply side containing portion 290 is prevented from reversely flowing to the air side containing portion 270 by a surface tension generated by a meniscus of the ink which is formed in the communicating portion 162 causing the supply side containing portion 290 and the air side containing portion 270 to communicate with each other.

When the ink in the first ink containing portion 292 is started to be consumed, the air flows into the first ink containing portion 292. Consequently, the liquid level of the first ink containing portion 292 is lowered. However, only lower parts of the first ink containing portion 292 and the second ink containing portion 294 communicate with each other through the connecting passage 276. Therefore, the ink in the first ink containing portion 292 is first consumed. When the ink in the first ink containing portion 292 is consumed so that the liquid level reaches the connecting passage 276, the ink in the second ink containing portion 294 is consumed. Correspondingly, the air also flows into the second ink containing portion 294. A surface tension is generated in the connecting passage 276 by the meniscus of the ink while the ink in the second ink containing portion is consumed. Consequently, the ink in the second ink containing portion 294 is prevented from reversely flowing to the first ink containing portion 292.

As described above, the inks in the air side containing portion 270, the first ink containing portion 292 and the second ink containing portion 294 are consumed in this order. Even if the liquid level of the ink is placed in any of the containing portions, the ink is supplied from the communicating portion 278 disposed in the vicinity of the partition wall 272 for vertically dividing the ink containing portion 111 into almost two parts to the ink supply portion 160 via a passage 300 through the through hole 918.

Figure 9:
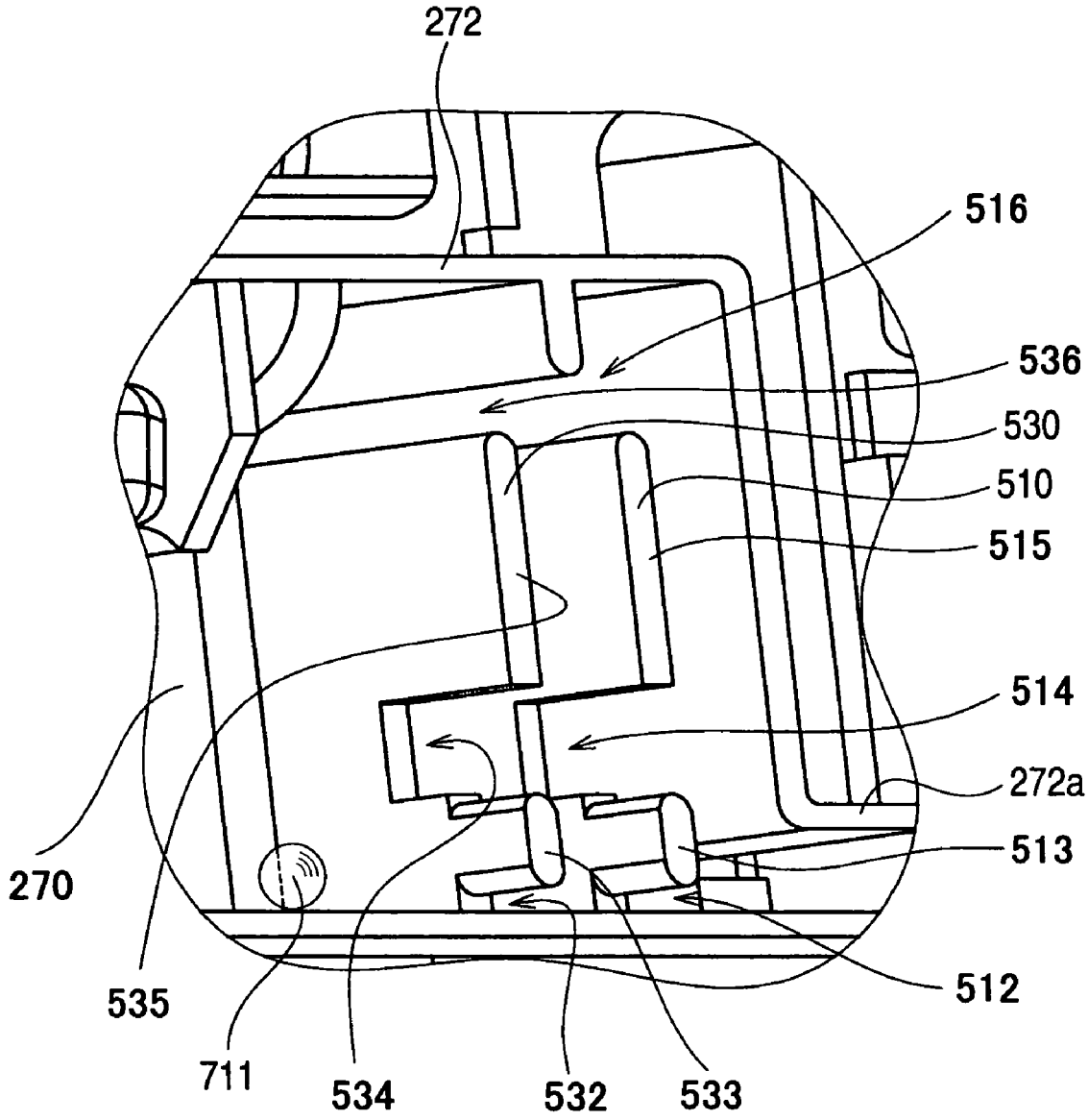
FIG. 9 is an enlarged perspective view showing a main part in FIG. 7.

FIG. 9 is a partially enlarged perspective view of FIG. 7. In the air side containing portion 270, a position in which a supply side partition wall 272*a* dividing an upper part of the connecting passage 274 provided with the communicating hole 163 is disposed is lower than that of another partition wall 272 in the air side containing portion 270. Moreover, the air side containing portion 270 has a first vertical partition wall portion 510 extended from a bottom face of the air side containing portion 270 vertically and upward and a second vertical partition wall portion 530 which is parallel with the first vertical partition wall portion 510 in the vicinity of the connecting passage 274.

The first vertical partition wall portion 510 has, at a lower end, a lower connecting passage 512 which penetrates through the first vertical partition wall portion 510 and causes a liquid to flow together with a bottom face of the air side containing portion 270. The lower connecting passage 512 is a notch obtained by taking away the first vertical partition wall portion 510. The first vertical partition wall portion 510 further has an upper connecting passage 514 which is provided above the lower connecting passage 512, penetrates through the first vertical partition wall portion 510 and causes the ink to flow with a lower passage resistance than that of the lower connecting passage 512.

In the embodiment shown in FIG. 9, the upper connecting passage 514 is a notch obtained by taking away the lower connecting passage 512 more greatly. Consequently, the passage resistance of the upper connecting passage 514 is lower than that of the lower connecting passage 512.

Furthermore, the upper connecting passage 514 is disposed above the supply side partition wall 272*a* with a lower wall portion 513 interposed together with the lower connecting passage 512.

The first vertical partition wall portion 510 further has a second upper connecting passage 516 through which the ink flows in a lower passage resistance than that of the lower connecting passage 512 with an upper wall portion 515 interposed together with the upper connecting passage 514. In the embodiment shown in FIG. 9, the second upper connecting passage 516 is a gap generated between the partition wall 272 and an upper end of the first vertical partition wall portion 510.

Since the second vertical partition wall portion 530 has the same structure as that of the first vertical partition wall portion 510, description will be omitted.

In addition, the first vertical partition wall portion 510 and the second vertical partition wall portion 530 are disposed on the back face of the passage 214 shown in FIG. 2. In the case in which the film 110 shown in FIG. 3 is stuck to the passage 214, accordingly, it is possible to prevent a "relief" in which the side surface of the cartridge body 120 provided with the passage 214 is concaved and the film 110 is thus stuck with difficulty.

As shown in FIG. 7, moreover, the first ink containing portion 292 of the supply side containing portion 290 has an inclined wall portion 550 which is inclined in a vertical direction. The inclined wall portion 550 is disposed above the connecting passage 295 which is extended in the vertical direction.

In the embodiment, as shown in FIG. 7, the stirring and moving member 711 is disposed in each of the air side containing portion 270 to be the liquid containing portion on the most base end and the second ink containing portion 294 to be the liquid containing portion provided just before the ink supply control means 150.

The stirring and moving member 711 according to the embodiment is a metallic ball which can freely roll and takes a spherical shape, and rolls in the containing portions by an inertia received in the moving operation of the ink cartridge 500 which is carried out by the carriage, thereby stirring the ink stored in the respective containing portions.

The stirring and moving member 711 is disposed in each of a section between the first vertical partition wall portion 510 and the second vertical partition wall portion 530 and a section provided on an opposite side to the first vertical partition wall portion 510 with the second vertical partition wall portion 530 interposed therebetween in the air side containing portion 270. In case of the second ink containing portion 294, moreover, the stirring and moving member 711 is provided in a section between the partition wall 288 having the passage 279 and the connecting passage 278.

In the case in which the stirring and moving member 711 provided in each of the containing portions rolls toward the partition wall side having the connecting passage, it approaches the connecting passages (for example, the connecting passages 278 and 279 and the lower connecting passages 512 and 532) opened to the bottom portion side of the partition wall. In that case, an outside diameter of the stirring and moving member 711 is set to be equal to or larger than a predetermined diameter with respect to the opening of the connecting passage in such a manner that a passage having a larger sectional area than the sectional area (opening area) of the connecting passage can be maintained between the surrounding partition wall of the connecting passage and the stirring and moving member 711 also when the stirring and moving member 711 approaches the connecting passages most greatly.

By taking, as an example, the case in which the stirring and moving member 711 approaches the lower connecting passage 532 formed on the second vertical wall portion 530 shown in FIG. 9 most greatly, specific description will be given to the passage maintained between the second vertical wall portion 530 and the stirring and moving member 711.

Figure 10:
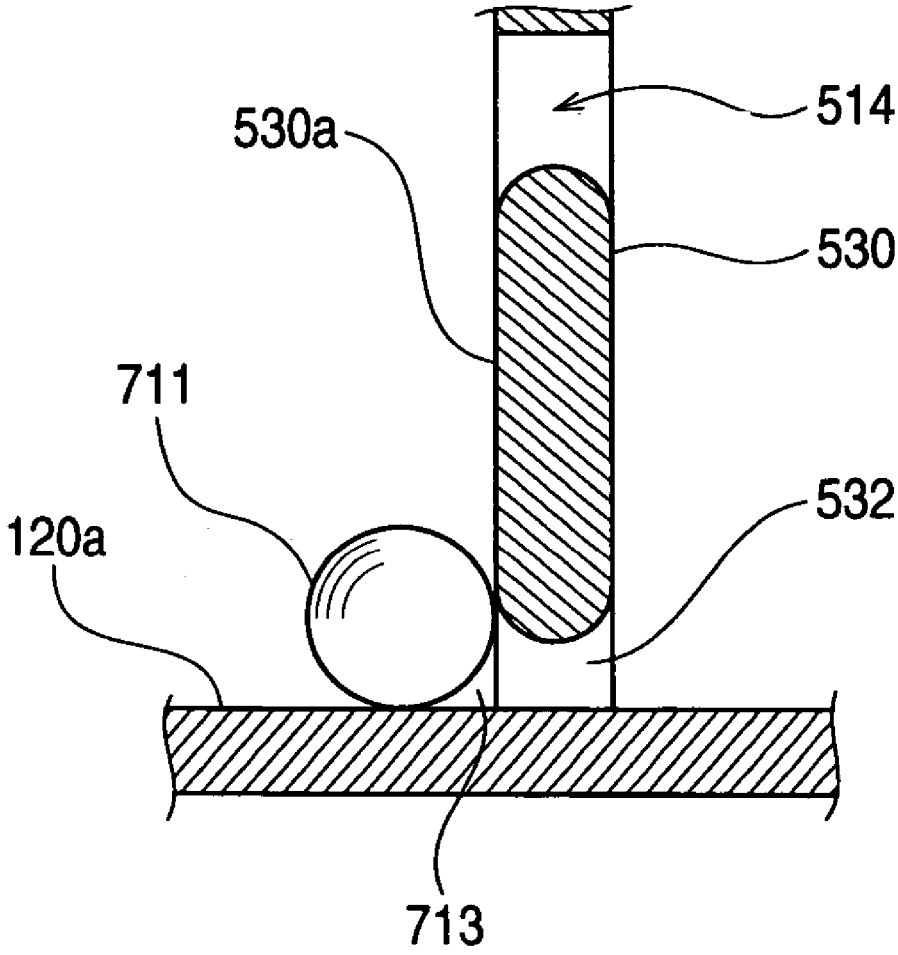
FIG. 10 is an enlarged sectional view showing a main part in FIG. 9.

As shown in FIG. 10, the stirring and moving member 711 approaching the lower connecting passage 532 stops in an abutment state on a surface 530*a* of the second vertical wall portion 530 and a surface 120*a* of a bottom wall.

At this time, in order to prevent the stirring and moving member 711 from disturbing the flow of the ink into the lower connecting passage 532, the outside diameter of the stirring and moving member 711 is set in such a manner that a passage (space) 713 formed between the surface 530*a* of the second vertical wall portion 530 and the surface 120*a* of the bottom wall, and the stirring and moving member 711 has a minimum opening sectional area which is larger than a minimum opening area of the lower connecting passage 532.

Figure 11:
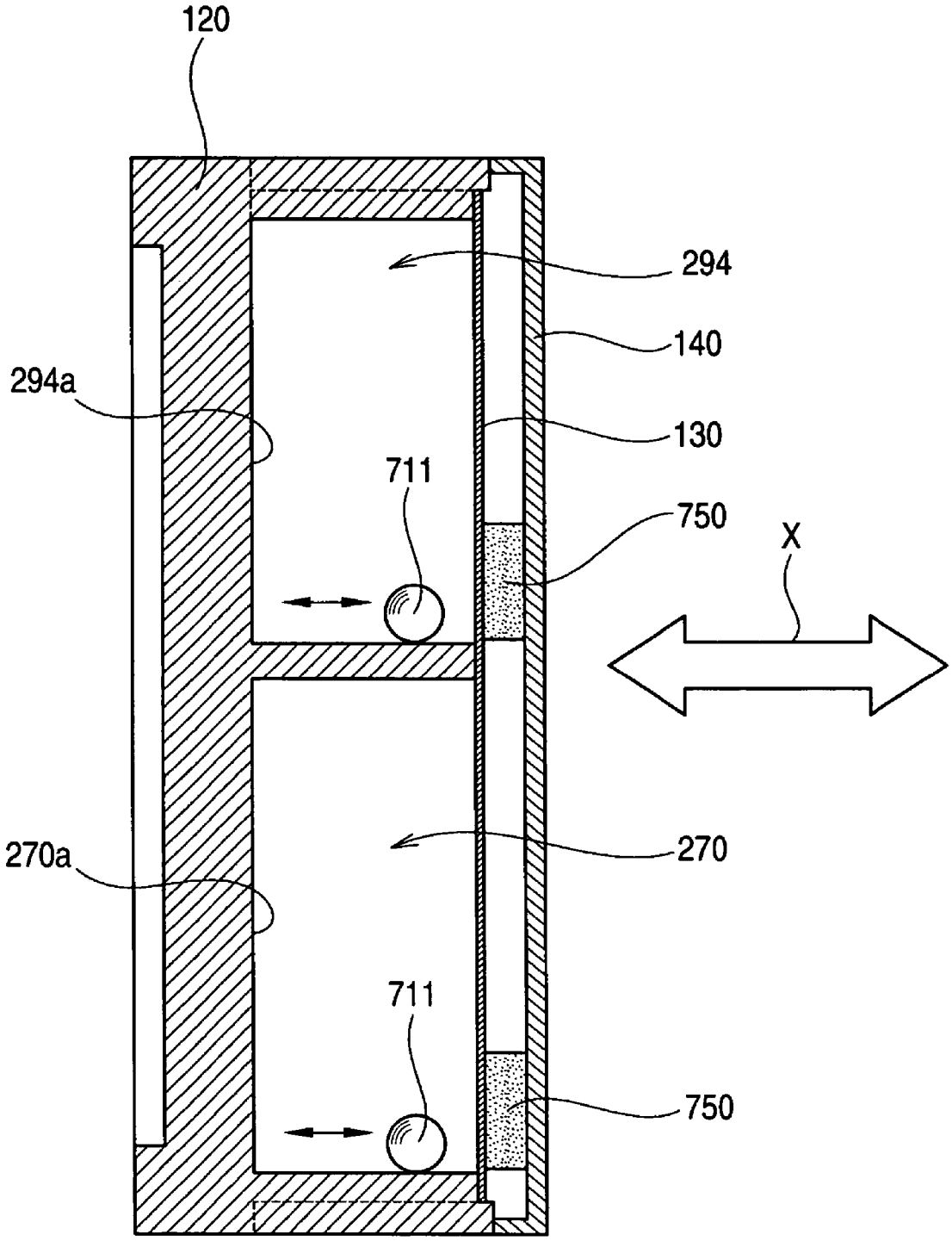
FIG. 11 is a schematic sectional view showing a positional relationship among a cartridge body and a film which constitute a liquid containing portion of the ink cartridge illustrated in FIG. 1, a lid member and a stirring and moving member in the liquid containing portion.

In the embodiment, as described above, the open portions of the liquid containing concave portions 270*a*, 292*a* and 294*a* formed in the cartridge body 120 are blocked with the film 130. Consequently, the ink containing portions 270, 292 and 294 are formed by a division and the lid member 140 formed of a resin is attached to cover the outside of the film 130. As shown in FIG. 11, a cushion member 750 to be a buffer member provided between the lid member 140 and the film 130 and serving to absorb a shock generated when the stirring and moving member 711 in each of the containing portions collides with the film 130 is stuck to an internal surface of the lid member 140.

In the embodiment, the cushion member 750 is provided in two places corresponding to the positions of the air side containing portion 270 and the second ink containing portion 294 in which the stirring and moving member 711 is put. The cushion member 750 is formed by a porous material having a proper elasticity.

Description will be given to the operation for supplying the ink in the case in which a pigment ink is accommodated as the ink in the air side containing portion 270 and the supply side containing portion 290 in the structure of the ink cartridge 500. As shown in FIGS. 2 and 7, the communicating portion 162 is provided to penetrate through the bottom face of the air side containing portion 270 in order to use up the ink in the air side containing portion 270 as greatly as possible, and the ink passing through the communicating portion 162 is supplied to the supply side containing portion 290.

Usually, a pigment to be a coloring material for the pigment ink is a dispersion particle which is disposed in a solvent. In the case in which the pigment is left for a long period of time, therefore, the dispersion particle sinks and a thick ink having a high concentration of the pigment is apt to be collected particularly in the vicinity of the connecting passage 274 provided with the communicating portion 162.

In the ink cartridge 500 according to the embodiment, however, the stirring and moving member 711 provided in the air side containing portion 270 and the second ink containing portion 294 can stir the ink stored in these containing portions, thereby preventing the sedimentation itself of the coloring material in the ink. Consequently, it is possible to prevent a phenomenon in which an ink having a high concentration of the pigment is stored in the vicinity of the connecting passage 274. In the ink cartridge 500 according to the embodiment, furthermore, the connecting passages distributed by the vertical division in one partition wall (the first vertical partition wall portion 510 and the second vertical partition wall portion 530) can cause a flow in a vertical direction which promotes the stirring operation in the supply of the ink and the stirring operation can be carried out actively by the synergy effect of both stirring functions so that a variation in the concentration is generated with difficulty over the ink to be supplied to the ink supply portion 160. In other words, it is possible to prevent a phenomenon in which the thick ink in the vicinity of the connecting passage 274 exactly flows out of the communicating portion 162 and the ink having a low concentration placed above the same thick ink then flows out. Thus, the concentration of the ink to be supplied to the outside can be prevented from being nonuniform.

According to the ink cartridge 500 in accordance with the embodiment, moreover, also in the case in which the stirring and moving members 711 accommodated in the air side containing portion 270 and the second ink containing portion 294 move so that they approach the lower connecting passages 512 and 532 and the connecting passages 278 and 279 which are formed to penetrate through the first and second vertical partition wall portions 510 and 530 and the partition wall 288 most greatly respectively, the minimum opening sectional area of the passage 713 (see FIG. 10) formed between the surrounding partition walls of the lower connecting passages 532 and 512 and the connecting passages 278 and 279 and each of the stirring and moving members 711 is set to be larger than the minimum opening sectional areas of the lower connecting passages 512 and 532 and the connecting passages 278 and 279.

In the ink cartridge 500, therefore, the stirring and moving member 711 can be prevented from blocking the lower connecting passages 512 and 532 and the connecting passages 278 and 279 to disturb the circulation of the ink and the ink in the air side containing portion 270 and the second ink containing portion 294 can be stirred by the stirring and moving member 711, and at the same time, the ink having a uniform concentration can be stably supplied from the lower connecting passages 512 and 532 and the connecting passages 278 and 279. Thus, it is possible to maintain the supply of the ink of high quality in which the concentration of the ink to be printed has no variation.

According to the ink cartridge 500 in accordance with the embodiment, for example, the stirring and moving members 711 provided in the ink containing portions 270 and 294 move in the ink containing portions 270 and 294 to collide with the film 130 together with the reciprocation of the print head. The film 130 is thinner and elastically deformed more easily as compared with the partition wall of the cartridge body 120. Therefore, the collision energy of the stirring and moving member 711 is absorbed by the elastic deformation of the film 130.

As a result, a collision sound and a vibration which are generated in the collision of the stirring and moving member 711 are reduced considerably so that an influence on a noise and precision in an operation can be eliminated.

According to the ink cartridge 500 in accordance with the embodiment, therefore, the stirring and moving members 711 in the ink containing portions 270 and 294 do not generate a great collision sound to be a noise, and furthermore, does not generate such a vibration as to influence the precision in the operation of the print head due to the collision of the stirring and moving member 711 so that the ink having a uniform concentration can be supplied with high precision by the stirring force of the stirring and moving member 711.

In the ink cartridge 500 according to the embodiment, furthermore, the cushion member 750 provided between the lid member 140 and the film 130 absorbs the collision sound and shock generated when the stirring and moving member 711 collides with the film 130. Therefore, the sound and vibration generated by the collision of the stirring and moving member 711 can be reduced more effectively so that the silence and the precision in the operation can be further enhanced.

Because of the structure in which the outside of the film 130 forming the ink containing portions 270 and 294 by the division is covered with the lid member 140, moreover, there is no possibility that the film 130 might interfere with the external apparatuses in handling and the film 130 might be thus broken, and the handling property is also excellent.

In the ink cartridge 500 according to the embodiment, furthermore, the first vertical partition wall portion 510 having the lower connecting passage 512, the upper connecting passage 514 and the second upper connecting passage 516 is provided. In the case in which the ink flows out of the communicating hole 163 so that it is further pulled toward the communicating hole 163, consequently, the amount of the thin ink flowing through the upper connecting passage 514 and the second upper connecting passage 516 is increased.

Therefore, the flow of the thin ink (arrows i and j in the drawing) is greater than the flow of the thick ink (an arrow h in the drawing) so that the thin ink can also flow into the communicating hole 163 in addition to the thick ink.

By a difference in the magnitude of the flow, moreover, upper and lower ink flows can be generated in the space divided by the connecting passage 274 and the first vertical partition wall portion 510 so that the thick ink and the thin ink, particularly, the thin ink placed above the vicinity of the upper connecting passage 514 can also be involved and stirred.

In particular, the upper connecting passage 514 is disposed above the supply side partition wall 272*a* opposed to the communicating hole 163. Therefore, the ink can easily be supplied to the upper supply side containing portion 290 which is divided by the lower 272*a*, and furthermore, the thin ink placed above the thick ink which is easily collected in the vicinity of the connecting passage 274 can be caused to flow toward the connecting passage 274. Moreover, the second upper connecting passage 516 is provided together with the partition wall 272 of the air side containing portion 270. Also in the case in which the amount of the ink in the air side containing portion 270 is large so that a difference in the concentration is increased, therefore, the upper thin ink can be caused to flow toward the communicating hole 163 and can be thus mixed with the lower thick ink reliably so that the mixture can be supplied to the supply side containing portion 290.

Moreover, the lower connecting passage 512 is provided on the lower end of the first vertical partition wall portion 510. Therefore, the flow of the ink can be prevented from being intercepted by the first vertical partition wall portion 510 and the ink in the air side containing portion 270 can be thus used up almost completely. Furthermore, the second vertical partition wall portion 530 having the lower connecting passages 532 and 534 and the second upper connecting passage 536 is provided in parallel with the first vertical partition wall portion 510. In the vicinity of the connecting passage 274, therefore, the thick ink and the thin ink can be mixed reliably.

In addition, the inclined wall portion 550 is provided above the connecting passage 295 into which the ink flows from the air side containing portion 270 through the communicating portion 162. Therefore, the flow of the ink from the air side containing portion 270 to the supply side containing portion 290 is received by the inclined wall portion 550 to change the direction of the flow. Consequently, the ink accommodated in the first ink containing portion 292 can be stirred so that the thick ink and the thin ink in the first ink containing portion 292 can be mixed.

Moreover, the lower connecting passage is provided with a plurality of small walls such as the vertical partition wall 271 having the connecting passage 276 and the vertical partition wall 288 having the communicating portion 279. Consequently, mixing with the lower thick ink can be carried out reliably and the mixture can be supplied to the supply side containing portion 290.

In the ink cartridge 500 according to the embodiment shown in FIGS. 7 to 9, the upper connecting passage 514 and the upper connecting passage 534 in the first vertical partition wall portion 510 and the second vertical partition wall portion 530 which make a pair are disposed in upper and lower positions which are identical to each other. However, the arrangement of the upper and lower positions is not restricted thereto but the upper connecting passage 514 and the upper connecting passage 534 may be provided in upper and lower positions which are different from each other.

Similarly, the second upper connecting passage 516 and the second upper connecting passage 536 may be provided in upper and lower positions which are different from each other. Consequently, it is possible to make a flow in the vertical direction of the thin ink in a region interposed between the first vertical partition wall portion 510 and the second vertical partition wall portion 530 which make the pair, thereby stirring the thick ink and the thin ink reliably.

While the first vertical partition wall portion 510 and the second vertical partition wall portion 530 which make the pair are provided vertically in the ink cartridge 500 according to the embodiment, furthermore, this is not restricted but both or either of the wall portions making the pair may be inclined to the vertical direction.

According to the ink cartridge 500 in accordance with the embodiment, therefore, the flow of the floating thin ink is increased in the vicinity of the communicating portion 162 in the air side containing portion 270. Consequently, the sinking thick ink and the floating thin ink are mixed and the mixture is supplied from the communicating portion 162 to the supply side containing portion 290. Accordingly, it is possible to suppress a variation in the thickness of the ink to be supplied to the outside.

While the ink containing portion 111 to be the liquid containing portion is formed by the bottomed cartridge body 120 which takes the almost box shape and includes the liquid containing concave portion 122 having the open front face to be one of the surfaces opposed to the direction X of the reciprocation of the print head and the film 130 for covering the open surface of the liquid containing concave portion 122 in the ink cartridge 500 according to the embodiment, moreover, it is also possible to form the liquid containing portion by the liquid containing concave portion having both open surfaces opposed to the direction X of the reciprocation of the print head and a pair of films for covering both open surfaces of the liquid containing concave portion.

Furthermore, the external shape of the stirring and moving member for accommodating the liquid containing portion therein is not restricted to the spherical shape described in the embodiment. For example, it is also possible to take a shape which can give rolling, for example, a shape of a column or a cylinder and other shapes.

In the case in which the external shape of the stirring and moving member is a sphere, a method of setting the outside diameter of the stirring and moving member 711 to be equal to or larger than a predetermined diameter as in the embodiment is effective as specific means for setting the minimum sectional area of the passage formed between the surrounding partition wall of the connecting passage and the stirring and moving member to be larger than the minimum opening sectional area of the connecting passage also when the stirring and moving member approaches the connecting passage most greatly.

Furthermore, the specific means for setting the minimum sectional area of the passage formed between the surrounding partition wall of the connecting passage and the stirring and moving member to be larger than the minimum opening sectional area of the connecting passage when the stirring and moving member approaches the connecting passage most greatly is not restricted to the selection of the outside diameter of the stirring and moving member 711 described in the embodiment.

Figure 12:
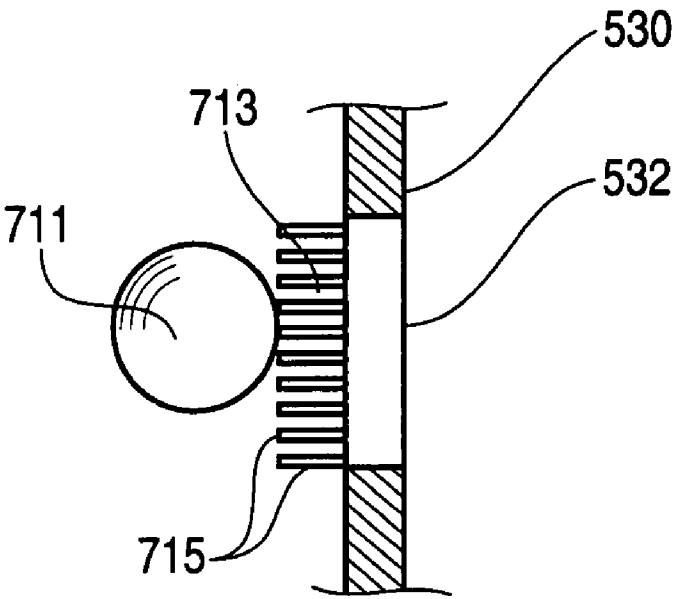
FIG. 12(*a*) is an enlarged sectional view showing a main part for explaining a structure of a stopper to block a movement of the stirring and moving member to a connecting passage side and FIG. 12(*b*) is a sectional view taken along an A-A line in (a).
Figure 12:
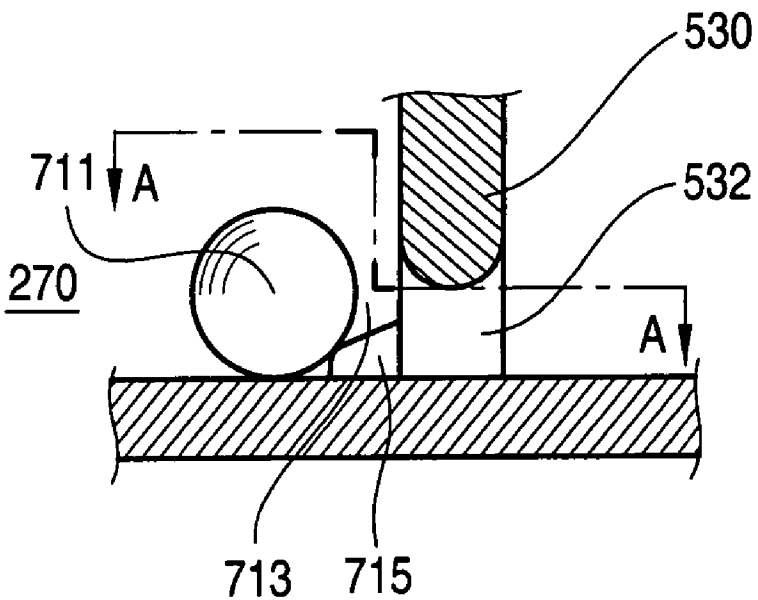
Figure 13:
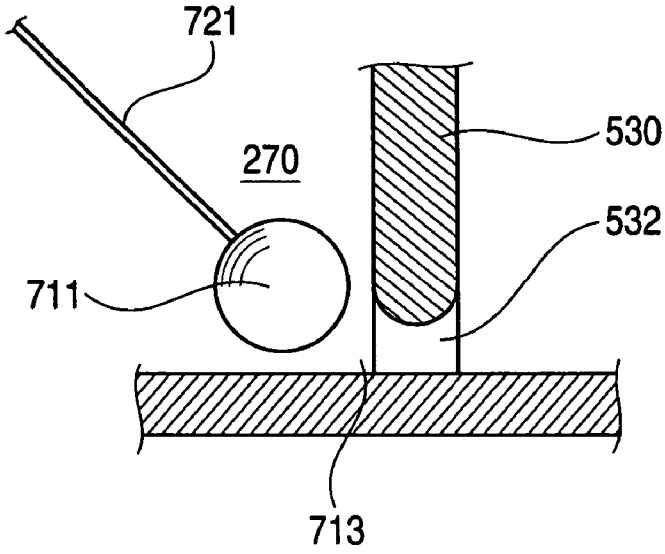
FIG. 13 is an enlarged sectional view showing a main part, illustrating a variant of the stopper to block the movement of the stirring and moving member to the connecting passage side.

For example, various correspondences illustrated in FIGS. 12 and 13 can be taken.

In specific means shown in FIG. 12(*a*), a stopper 715 for blocking the roll of the stirring and moving member 711 toward the lower connecting passage 532 side to regulate the closest distance is provided on the internal wall (the surface 120*a* of the bottom wall) on this side of the lower connecting passage 532 that the stirring and moving member 711 approaches.

The stopper 715 is formed by a rib projection (protrusion) extended in the direction of the flow of the ink passing through the lower connecting passage 532, and is arranged in a plurality of lines at a proper pitch which is smaller than the outside diameter of the stirring and moving member 711 as shown in FIG. 12(*b*).

The stopper formed by the projection is effective also in the case in which the stirring and moving member 711 takes a contour shape other than the sphere described above or the case in which the spherical stirring and moving member 711 having a small outside diameter is used. As a matter of course, it is apparent that the projection shape can take various configurations.

In the specific means shown in FIG. 13, there is provided a stopper 721 for connecting the internal wall of the air side containing portion 270 to the stirring and moving member 711. The stopper 721 is formed by a flexible member having a predetermined length and serves to regulate the closest distance of the stirring and moving member 711 to the lower connecting passage 532 depending on a length of the stopper 721.

Next, description will be given to a suitable configuration for the stirring and moving member for accommodating the liquid containing portion therein.

In the embodiment, as shown in FIG. 7, the stirring and moving member 711 having a greater specific gravity than that of the accommodated ink is disposed in each of the air side containing portion 270 to be the liquid containing portion on the most base end and the second ink containing portion 294 to be the liquid containing portion provided just before the ink supply control means 150. In the embodiment, the stirring and moving member 711 takes the external shape of the sphere and rolls in the liquid containing portion by the inertia received in the moving operation of the ink cartridge 500 carried out by the carriage, thereby stirring the ink stored in the respective liquid containing portions.

For a material constituting the stirring and moving member 711, it is possible to use plastics such as nylon, polyacetal (POM), fluoric resin, polycarbonate or polypropylene, glass, ceramics (for example, $Al_2O_3$ or $ZrO_2$), rubber or metals.

Figure 14:
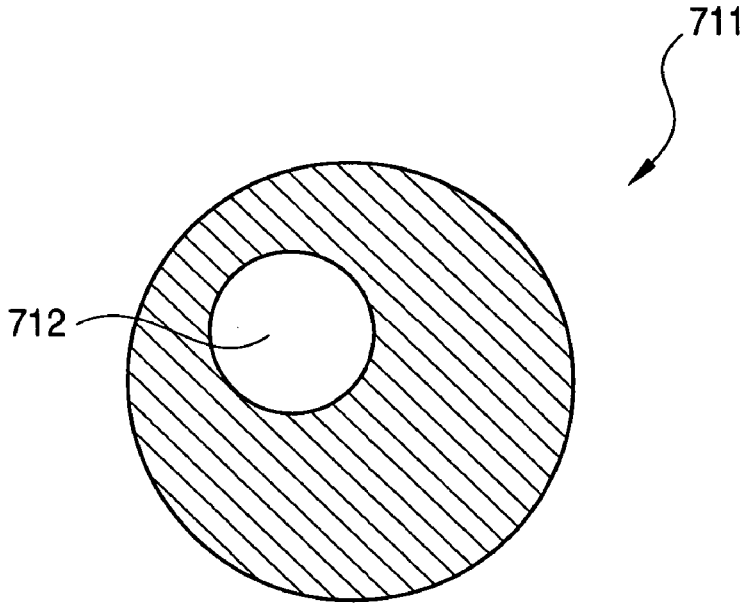
FIG. 14 is a sectional view showing the stirring and moving member illustrated in FIG. 7.

Although the stirring and moving member 711 takes the external shape of the sphere, moreover, a central position with respect to the external shape is different from a position of a center (a center of gravity) of a mass. For a structure in which the center and the center of gravity with respect to the external shape are thus different from each other, it is preferable that a thickness of a coating layer on a surface should be partially changed to cause the central position with respect to the external shape to be different from the position of the center (the center of gravity) of the mass in the case in which a surface of a sphere formed by a certain material is coated with a different material, for example. As shown in a sectional view of FIG. 14, moreover, it is also possible to take a shape in which a hollow portion 712 inclined to the external shape is provided. In place of the hollow portion 712, a through hole penetrating through the stirring and moving member 711 may be formed or a concave portion which is concaved greatly from an external surface may be provided. In addition, a convex portion protruded greatly from the external surface may be provided.

Figure 15:
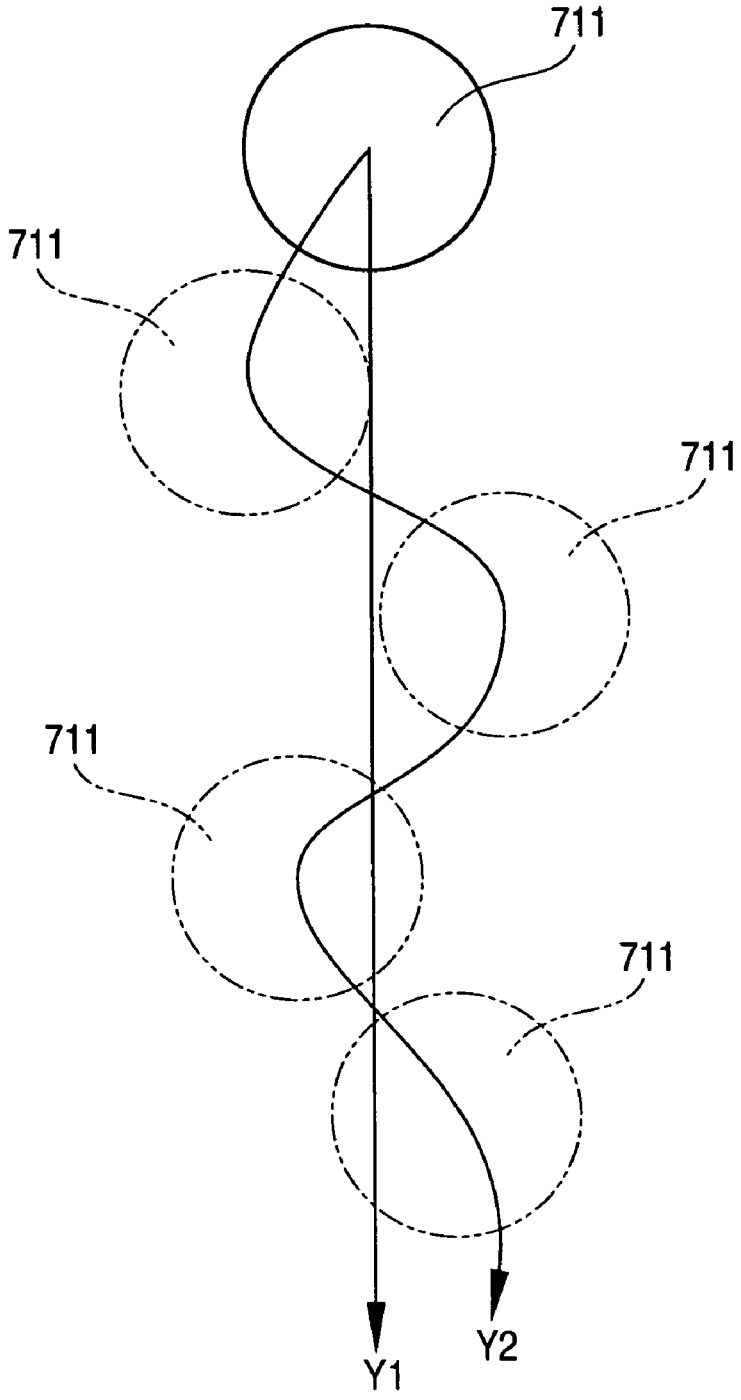
FIG. 15 is a view showing a state in which the stirring and moving member illustrated in FIG. 7 rolls.

Thus, the center of gravity of the stirring and moving member 711 is present in a position shifted from the center of the external shape so that the stirring and moving member 711 rolls irregularly in the liquid containing portion. In case of a conventional stirring and moving member in which an external shape is a sphere, and furthermore, a center of gravity is almost coincident with a center of the external shape, for example, it rolls regularly corresponding to the inertia of the center of gravity and a direction of the rolling operation is almost linear as shown in an arrow Y1 of FIG. 15. In case of the stirring and moving member 711 according to the embodiment, it irregularly rolls with a swing as shown in an arrow Y2 by a force generated through the inertia of the center of gravity and a resisting force of the ink which acts on the external surface, for example. Consequently, the stirring and moving member 711 according to the embodiment can cause an irregular force to act in various directions with respect to the surrounding ink. As compared with the linear rolling operation shown in the direction of the arrow Y1, it is possible to obtain a more excellent stirring function.

Figure 16:
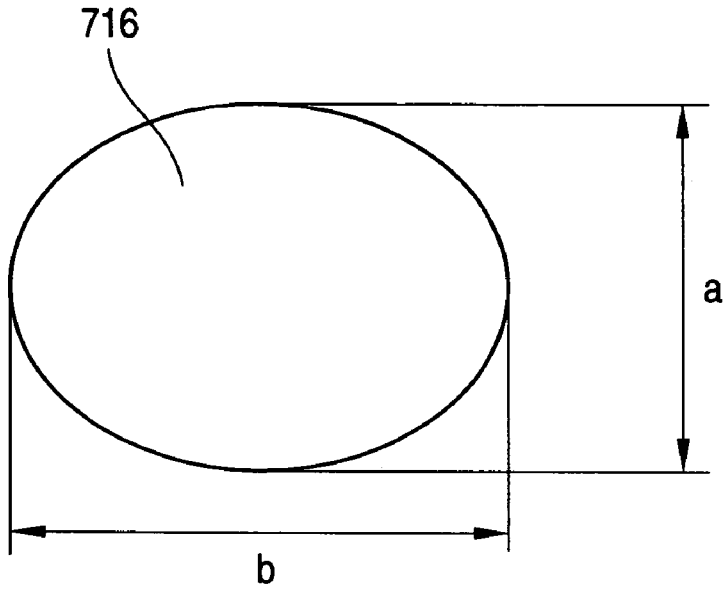
FIG. 16 is a front view showing another example of the stirring and moving member illustrated in FIG. 7.

In place of the stirring and moving member 711 taking a basic shape of the sphere, moreover, it is also possible to use a stirring and moving member 716 taking a shape of an elliptical sphere as shown in FIG. 16. In consideration of the fact that an excellent stirring function is obtained by an irregular rolling operation, it is preferable that the stirring and moving member 716 taking the shape of the elliptical sphere should have a proper difference between a minor axis a and a major axis b and a ratio a/b of the minor axis a to the major axis b should be equal to or lower than 0.9. More preferably, the ratio a/b is set to be equal to or lower than 0.8. In place of the stirring and moving member 716 taking the shape of the elliptical sphere, moreover, it is also possible to use a stirring and moving member having a shape such as a polyhedron which rolls irregularly. In that case, it is possible to increase the stirring function by the corner portions of the polyhedron. In the stirring and moving member having the external shape to roll irregularly, thus, any position of the center of gravity can be taken. It is preferable that the center of gravity should be shifted from the center of the external shape.

Figure 17:
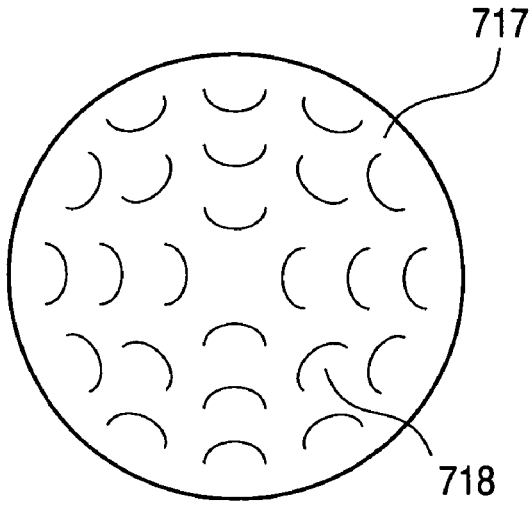
FIG. 17 is a front view showing yet another example of the stirring and moving member illustrated in FIG. 7.

As the structure of the stirring and moving member for obtaining the excellent stirring function, moreover, it is also possible to provide a concave portion or a convex portion on a surface irrespective of the external shape and the position of the center of gravity. For example, also in a stirring and moving member 717 having a so-called dimple shape provided with a plurality of concave portions 718 on a surface as shown in FIG. 17, it is possible to obtain an excellent stirring function. In place of the concave portions 718, furthermore, a plurality of convex portions may be provided. When such concave and convex portions are provided, a function for stirring a surrounding liquid is generated by the rotation of the stirring and moving member 718 also in the case in which the stirring and moving member 718 simply rolls (regularly). As compared with the conventional stirring and moving member, therefore, the stirring function is increased.

Figure 18:
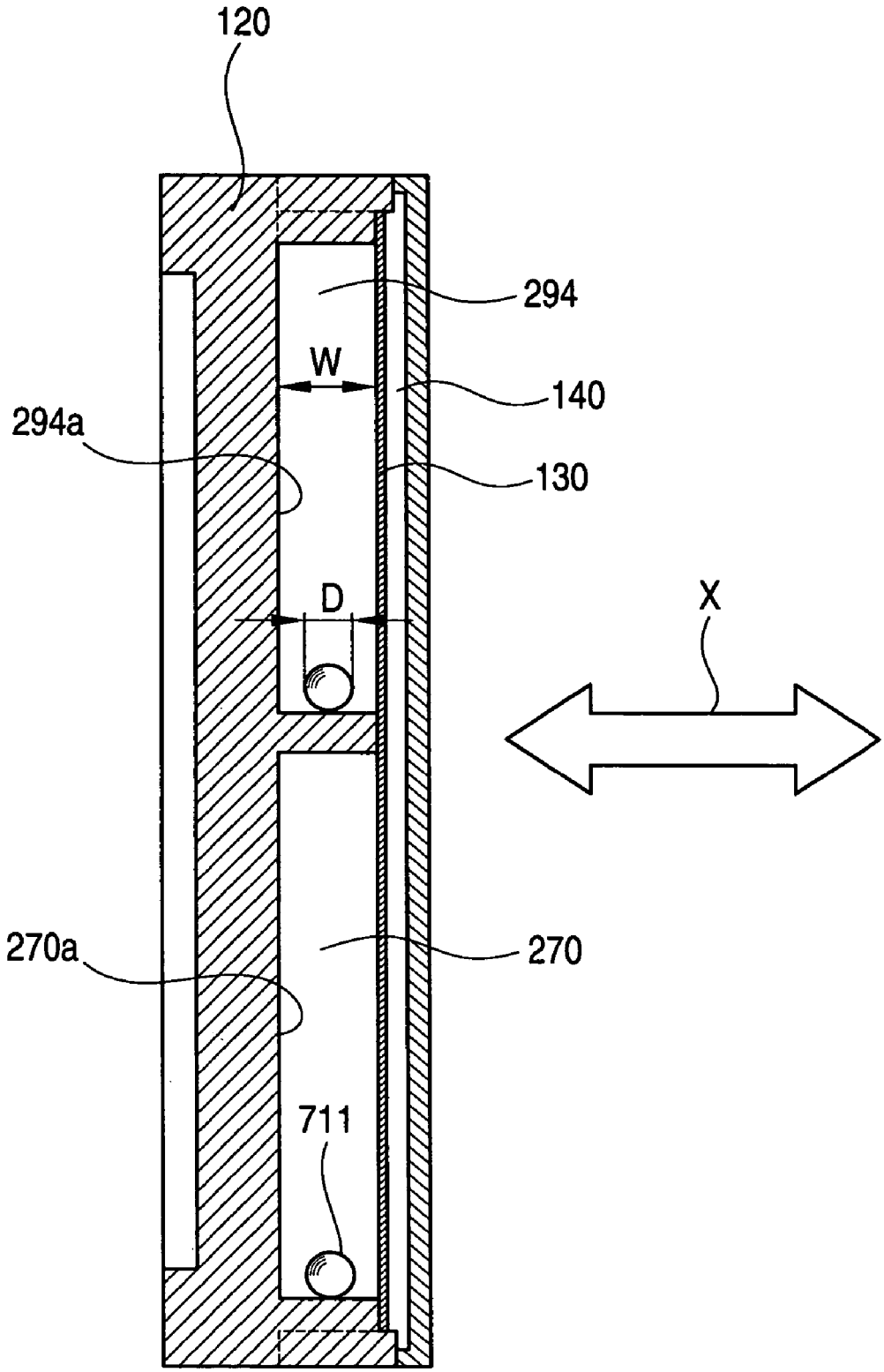
FIG. 18 is a sectional view in the direction of the reciprocation of the ink cartridge illustrated in FIG. 1.

As shown in FIG. 18, the open portions of the concave portions 270*a*, 292*a* and 294*a* formed on the cartridge body 120 are blocked with the film 130 so that the ink containing portions 270, 292 and 294 are formed and the lid member 140 formed by a resin is attached to cover the outside of the film 130. The ink cartridge 500 moves in the direction of the reciprocation of the liquid ejecting head (the direction of the arrow X). Consequently, the stirring and moving member 711 also moves actively in the direction of the reciprocation. As a suitable embodiment, therefore, a diameter D of the stirring and moving member 711 is set based on an internal width W of the ink containing portions 270, 292 and 294 in the direction of the reciprocation of the liquid ejecting head. If the diameter D is 0.4 time as large as the internal width W or more and is 0.8 time as large as the internal width W or less, that is, "0.4 W≦D≦0.8 W" is set, it is possible to obtain an excellent stirring function for the ink.

In order for the stirring and moving member 711 to stir the inkwell, it is desirable that the stirring and moving member 711 should collide with the concave portions 270*a*, 292*a* and 294*a* and the film 130 and should thus rebound and reciprocate repetitively in the ink containing portions 270, 292 and 294 when the liquid ejecting head reciprocates.

If the diameter D of the stirring and moving member 711 is smaller than 0.4 time as large as the internal width W, therefore, the stirring and moving member 711 is too small for the ink containing portions 270, 292 and 294 and is hard to reciprocate repetitively. Furthermore, the function of the stirring and moving member 711 to stir the ink greatly depends on the draining function obtained by the movement of the stirring and moving member 711. Therefore, a volume of the stirring and moving member 711 is too small so that it is hard to sufficiently obtain the stirring function.

If the diameter D of the stirring and moving member 711 is greater than 0.8 time as large as the internal width W, moreover, the draining function is increased. To the contrary, the distance of the reciprocation in the ink containing portions 270, 292 and 294 is shortened so that it is hard to sufficiently obtain the stirring function.

By setting the diameter D of the stirring and moving member 711 to be 0.4 time as large as the internal width W or more and to be 0.8 time as large as the internal width W or less, thus, the stirring and moving member 711 actively moves in the direction of the reciprocation of the liquid ejecting head in the ink containing portions 270, 292 and 294 so that an excellent stirring function can be obtained.

The shape of the stirring and moving member 711 is not restricted to the sphere. For example, it is also possible to take a columnar shape and a cylindrical shape. Also in that case, it is preferable that a diameter of a circular section should be set to be 0.4 time as large as the internal width W or more and to be 0.8 time as large as the internal width W or less in the same manner as the case of the spherical shape.

As described above, according to the ink cartridge 500 in accordance with the embodiment, the excellent stirring performance of the ink can be obtained by the structure of the liquid containing portion, and furthermore, it is possible to provide the stirring and moving member 711 having the excellent stirring function in the liquid containing portion to positively stir the ink by the reciprocation of the carriage mounting the liquid ejecting head thereon.

It is possible to decide the stirring function based on the following standard.

The ink cartridge 500 is put in a centrifugal separator and is rotated for 12 hours at a rotating speed of 1000 rpm to centrifugally separate the ink. Then, each of the ink cartridges 500 subjected to the centrifugal separation is mounted on the liquid ejecting head of the ink jet type recording apparatus again to carry out printing in a color patch having a gray gradation. A color difference ΔE of the gray printing carried out before and after the centrifugal separation is measured. It is possible to decide the gray printing having a color difference ΔE of ΔE≦4 to be A (a very excellent stirring property), the gray printing having a color difference ΔE of 4<ΔE≦8 to be B (an excellent stirring property), and the gray printing having a color difference ΔE of 8<ΔE to be C (a poor stirring property). As an equation for calculating the color difference ΔE, there is used the following equation (1) referring to an L*a*b* chromaticity diagram which is generally known.

$$\Delta E=\{(\Delta L^*)^2+(\Delta a^*)^2+(\Delta b^*)^2\}^{1/2} \quad (1)$$

The structures of the liquid containing portion, the cartridge body, the liquid containing concave portion, the partition wall, the connecting passage, the stirring and moving member, the passage, the film and the stopper in the liquid container according to the invention are not restricted to the structures according to the embodiment but it is a matter of course that various configurations can be taken based on the scope of the invention.

While the description has been given by taking, as an example, the ink cartridge which can be attached/removed to/from the carriage mounting the liquid ejecting head thereon in the embodiment, moreover, it is also possible to cause a subtank to have the structure according to the invention in an apparatus having such a structure that a main tank is fixed to a recording apparatus body, the main tank is connected to the subtank mounted on a carriage through a tube, and furthermore, an ink in the subtank can be supplied to a head, and to obtain the same advantages.

The application is based on Japanese Patent Application (Japanese Patent Application No. 2004-178385) filed on Jun. 16, 2004, Japanese Patent Application (Japanese Patent Application No. 2004-181061) filed on Jun. 18, 2004, Japanese Patent Application (Japanese Patent Application No. 2004-181062) filed on Jun. 18, 2004, and Japanese Patent Application (Japanese Patent Application No. 2004-182461) filed on Jun. 21, 2004, and their contents are incorporated herein by reference.

The invention claimed is:

1. A liquid container adapted to be mounted on a carriage to reciprocate together with a liquid ejecting head comprising:

a container body having a liquid containing concave portion and at least one open surface arranged to intersect with a direction of reciprocation of the liquid ejecting head when the liquid container is mounted on the carriage, wherein the container body comprises:

a vertical partition wall arranged so as to extend in a vertical direction when the liquid container is mounted on the carriage;

a lower connecting passage disposed in a lower portion of the vertical partition wall when the liquid container is mounted on the carriage;

a first upper connecting passage disposed in the vertical partition wall at a position upper than the lower connecting passage when the liquid container is mounted on the carriage;

a second upper connecting passage disposed at a position above an upper end of the vertical partition wall when the liquid container is mounted on the carriage where at least a portion of the second upper connecting passage is disposed along substantially the same vertical plane as the vertical partition wall;

a partition wall dividing the liquid containing portion into an upper liquid containing portion and a lower liquid containing portion; an upper vertical partition wall, in the upper liquid containing portion, with a second lower connecting passage and a third upper connecting passage;

a connection passage arranged on a inner surface of the container body so as to extend in a vertical direction to connect the upper liquid containing portion and the lower liquid containing portion when the liquid container is mounted on the carriage; and an inclined wall portion disposed on the inner surface of the container body above the connecting passage when the liquid container is mounted on the carriage;

a film sealing the open surface and forming a liquid containing portion together with the liquid containing concave portion, the liquid containing portion storing a liquid to be supplied to the liquid ejecting head; and a stirring and moving member accommodated in the liquid containing portion in a movable state.

2. The liquid container according to claim 1, wherein the film is welded to a first surface of the container body so that the open surface of the liquid containing concave portion is sealed.

3. The liquid container according to claim 1 or 2, further comprising a lid member fixed to the container body with an outside of the film covered therewith, and a buffer member provided between the lid member and the film and serving to absorb a shock generated when the stirring and moving member in the liquid containing portion collides with the film.

4. The liquid container according to claim 1 or 2, wherein the stirring and moving member takes a rollable shape.

5. The liquid container according to claim 1, wherein the liquid in the liquid containing portion is a pigment ink.

6. A liquid container adapted to be mounted on a carriage to reciprocate together with a liquid ejecting head comprising:

a container body having a liquid containing concave portion and at least one open surface arranged to intersect with a direction of reciprocation of the liquid ejecting head when the liquid container is mounted on the carriage, wherein the container body comprises:

a vertical partition wall arranged so as to extend in a vertical direction when the liquid container is mounted on the carriage;

a lower connecting passage disposed in a lower portion of the vertical partition wall when the liquid container is mounted on the carriage;

a first upper connecting passage disposed in the vertical partition wall at a position upper than the lower connecting passage when the liquid container is mounted on the carriage; and a second upper connecting passage disposed at a position above an upper end of the vertical partition wall when the liquid container is mounted on the carriage where at least a portion of the second upper connecting passage is disposed along substantially the same vertical plane as the vertical partition wall;

wherein the vertical partition wall, the lower connecting passage, the first upper connecting passage and the second upper connecting passage are arranged in a substantially vertical direction in the container a partition wall dividing the liquid containing portion into an upper liquid containing portion and a lower liquid containing portion; a connecting passage arranged on an inner surface of the container body to connect the upper liquid containing portion and the lower liquid containing portion; an upper vertical partition wall, in the upper liquid containing portion, with a second lower connecting passage and a third upper connecting passage;

a film sealing the open surface and forming a liquid containing portion together with the liquid containing concave portion, the liquid containing portion storing a liquid to be supplied to the liquid ejecting head; and a stirring and moving member accommodated in the liquid containing portion in a movable state.

7. The liquid container according to claim 6, wherein the film is welded to a surface of the container body so that the open surface of the liquid containing concave portion is sealed.

8. The liquid container according to claim 6, further comprising a lid member fixed to the container body with an outside of the film covered therewith, and a buffer member provided between the lid member and the film and serving to absorb a shock generated when the stirring and moving member in the liquid containing portion collides with the film.

9. The liquid container according to claim 6, wherein the stirring and moving member takes a rollable shape.

10. The liquid container according to claim 6, wherein the liquid in the liquid containing portion is a pigment ink.

11. A liquid container adapted to be mounted on a carriage to reciprocate together with a liquid ejecting head comprising:

a container body having a liquid containing concave portion and at least one open surface arranged to intersect with a direction of reciprocation of the liquid ejecting head when the liquid container is mounted on the carriage, wherein the container body comprises:

a partition wall dividing the liquid containing portion into an upper liquid containing portion and a lower liquid containing portion a vertical partition wall, in the lower liquid containing portion, with a lower connecting passage and an upper connecting passage; an upper vertical partition wall, in the upper liquid containing portion and adjacent an inclined wall portion, with a second lower connecting passage and a second upper connecting passage;

a connection passage arranged on an inner surface of the container body to connect the upper liquid containing portion and the lower liquid containing portion when the liquid container is mounted on the carriage; and a film sealing the open surface and forming a liquid containing portion together with the liquid containing concave portion, the liquid containing portion storing a liquid to be supplied to the liquid ejecting head; and a stirring and moving member accommodated in the liquid containing portion in a movable state.

12. The liquid container according to claim 11, wherein the film is welded to a surface of the container body so that the open surface of the liquid containing concave portion is sealed.

13. The liquid container according to claim 11, further comprising a lid member fixed to the container body with an outside of the film covered therewith, and a buffer member provided between the lid member and the film and serving to absorb a shock generated when the stirring and moving member in the liquid containing portion collides with the film.

14. The liquid container according to claim 11, wherein the stirring and moving member takes a rollable shape.

15. The liquid container according to claim 11, wherein the liquid in the liquid containing portion is a pigment ink.

* * * * *